US008579671B2

(12) United States Patent
DeRennaux et al.

(10) Patent No.: US 8,579,671 B2
(45) Date of Patent: Nov. 12, 2013

(54) CUSTOM REMOTE CONTROLLED VEHICLE KIT

(76) Inventors: Rick DeRennaux, Moore, OK (US); Paul Berman, Santa Monica, CA (US)

( * ) Notice: Subject to any disclaimer, the term of this patent is extended or adjusted under 35 U.S.C. 154(b) by 1160 days.

(21) Appl. No.: 12/135,136

(22) Filed: Jun. 6, 2008

(65) Prior Publication Data

US 2009/0017714 A1 Jan. 15, 2009

Related U.S. Application Data

(60) Provisional application No. 60/933,335, filed on Jun. 6, 2007, provisional application No. 60/971,920, filed on Sep. 13, 2007, provisional application No. 61/056,058, filed on May 26, 2008.

(51) Int. Cl.
*A63H 17/00* (2006.01)

(52) U.S. Cl.
USPC ..... 446/93; 446/88

(58) Field of Classification Search
USPC ..... 446/93
See application file for complete search history.

(56) References Cited

U.S. PATENT DOCUMENTS

| | | | | | |
|---|---|---|---|---|---|
| 3,654,727 | A * | 4/1972 | Span et al. | 446/94 |
| 4,406,085 | A * | 9/1983 | Rhodes | 446/456 |
| 4,878,877 | A * | 11/1989 | Auer et al. | 446/463 |
| 5,816,888 | A * | 10/1998 | Myers | 446/456 |
| 6,027,391 | A | 2/2000 | DeRennaux | |
| 2002/0127944 | A1 * | 9/2002 | Spector | 446/85 |
| 2006/0111048 | A1 * | 5/2006 | Inomata | 455/66.1 |
| 2007/0035412 | A1 * | 2/2007 | Dvorak et al. | 340/825.69 |
| 2008/0125002 | A1 * | 5/2008 | Goitein | 446/57 |

OTHER PUBLICATIONS

Attached yellow poster was in public view in Mar. 2007.

* cited by examiner

*Primary Examiner* — Tramar Harper
(74) *Attorney, Agent, or Firm* — Muskin & Farmer LLC

(57) ABSTRACT

A method, apparatus, and computer software to provide a kit which allows an operator to construct a variety of vehicles such as cars, boats, hovercraft, airplanes, etc. The operator can use software to select characteristics of the vehicles, and then print out sheets of paper or other thin material that can then be folded into a vehicle. Motors can be inserted into each vehicle in order to propel the vehicle. The kit can also comprise special tools which allow for forming the paper or other material into particular three dimensional shapes. The kit can also comprise a remote control transmitter and receiver so that the vehicles can be controlled remotely.

4 Claims, 23 Drawing Sheets

CUSTOM REMOTE CONTROLLED VEHICLE KIT

CROSS REFERENCE TO RELATED APPLICATIONS

This application claims benefit to provisional application 60/933,335 filed Jun. 6, 2007, which is incorporated by reference herein in its entirety. This application also claims benefit to provisional application 60/971,920 filed Sep. 13, 2007, which is incorporated by reference herein in its entirety. This application also claims benefit to provisional application 61/056,058 filed May 26, 2008, which is incorporated by reference herein in its entirety. This application is also related to U.S. Pat. No. 6,027,391, which is incorporated by reference herein in its entirety.

BACKGROUND OF THE INVENTION

1. Field of the Invention

The present inventive concept relates to a custom motorized vehicle kit to enable a user to create, customize and construct paper model remote controlled vehicles using interchangeable common control and drive modular components.

2. Description of Prior Art

Conventional model vehicles are often bought pre-assembled with little or no design input from the consumer. Such versions of model kits allow for minimum level of input in decorative details of the model vehicle by allowing for the application of color or design to exterior of the vehicle. See for example U.S. Pat. Nos. 4,266,366, 4,327,615, 4,551,810, 5,341,305, 5,513,991, 5,559,709 and applicant's own U.S. Pat. No. 6,027,391.

Applicant's prior art patent hereinafter referred to as '391 teaches the use of a kit comprising a compact disk containing information readable by a personal computer. The computer allows for the depiction of images of pre-designed vehicles on a monitor and computer readable instructions to allow the print-out of two dimensional patterns of the design vehicle. The '391 patent only provides a user access to two dimensional images of model vehicles and limited adaptability and pre-fabrication testing.

SUMMARY OF THE INVENTION

It is an aspect of the present inventive concept to provide a kit to allow for creation of a wide variety of toy vehicles.

The above aspects can be obtained by an apparatus that includes (a) a motor; and (b) computer software to design a vehicle body printed on a substrate which is attached to the motor.

These together with other aspects and advantages which will be subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
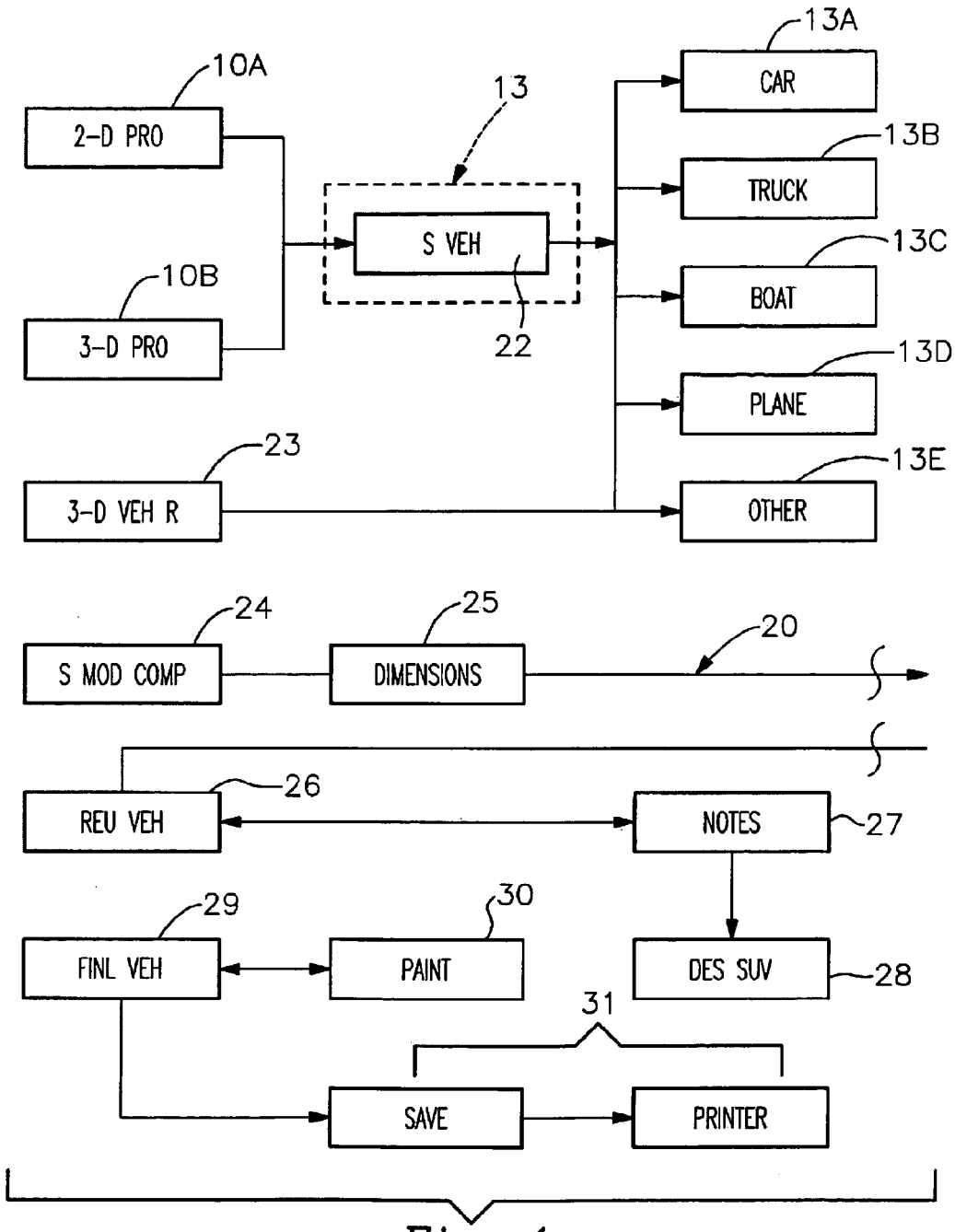
FIG. 1 is a block flow diagram of a vehicle selection and modification method, according to an embodiment.

Reference will now be made in detail to the presently preferred embodiments of the invention, examples of which are illustrated in the accompanying drawings, wherein like reference numerals refer to like elements throughout.

The present invention comprises a kit that provides a novel combination of components that allows users to create and customize remote control paper model vehicles from various types of paper or other thin construction material.

In one embodiment, computer drafting software is incorporated in the kit which allows for the manipulation of models in two dimensional and three dimensional forms on a computer output device. Users have the ability to modify dimensions, colors and shapes of the vehicles. The software can be included inside the kit itself or be accessible remotely, e.g., using a computer communications network such as the Internet to access a remote server where the software can be downloaded or run remotely. The kit as described herein would include such remotely accessed software even if such software is not physically supplied with the kit itself.

The kit can further comprise a remote control transmitter receiver, foldable fabrication material, interchangeable control and drive controllers to allow a user to create multiple vehicle configurations. The kit can also include various tools to help shape the original construction material (e.g., paper) into desired three dimensional shapes. The kit can be used to create toy land vehicles and toy air vehicles. Land vehicles are vehicles that cannot directly be controlled to rise off the ground, such as cars, trucks, etc. Air vehicles are vehicles that can travel on the ground but can also be controlled to rise above the ground for a substantial period of time (e.g., more than 10 seconds).

Referring now to FIG. 1, the kit can comprise software programs which can comprise modeling software such as 2-D software 10A (or "flat pattern" software) which allows the user to create 2-D images on a computer screen (or upload previous images such as JPGs) which can then be printed on the paper which will serve as decoration for the assembled toy vehicle. Flat pattern software is used to create two dimensional flat patterns that can be cut-out, folded and/or glued to create 3D vehicles. The flat patterns may also include decorative prints or patterns. The software can also comprise 3-D software 10B which can be used to design the mechanical components of paper model vehicles 13. Three-dimensional models designed using the 3-D software can then be converted into a 2-D flat pattern image which can then be printed on paper (or other substrate). The printed 2-D image embodies the three-dimensional model in that the printed pages can be cutout, folded, and bonded (e.g., taped, glued, etc.) along lines on the pages to create a paper three dimensional structure resembling the modeled three-dimensional image from the software.

The kit can comprise a controller for powering motors, a propeller (or other propulsion device), a remote control receiver, and a remote control transmitter control module. A controller is a group of components on the toy vehicle that sends a desired amount of power to motors on toy vehicle. The control can comprise a power supply, receiver, processing unit, and output connections to connect to motors (or other electronically operative devices). The receiver receives signals from a remote control transmitter. A processor processes those signals and generates actual current amounts, which are then sent to respective motor(s) on the toy vehicle (e.g., steering motor, propelling motor, etc.) Thus, the controller can comprise the receiver, power supply, processors, and outputs to the motor(s).

Using the software elements of one embodiment of the present invention and a personal computer (not shown), the user can create models 13 that can be depicted on the computer output device as 2-D flat-patterns or as 3-D models. The user will have the ability to modify parameters of the model 13.

The software of the kit will provide a user (not shown) with at least one basic model 13 of a vehicle. This basic model may be a car 13A, truck 13B, boat 13C, plane 13D or other type of transport indicated at 13E (e.g., butterfly, robot, or any item that moves). The software can allow for two-dimensional and three-dimensional editing capabilities that allow a user to modify predesigned models. The user can also generate his or her own entirely new models from scratch as well. It will also be seen that by modifying the select parameters numerous versions of the basic model 13 may be created.

Figure 2:
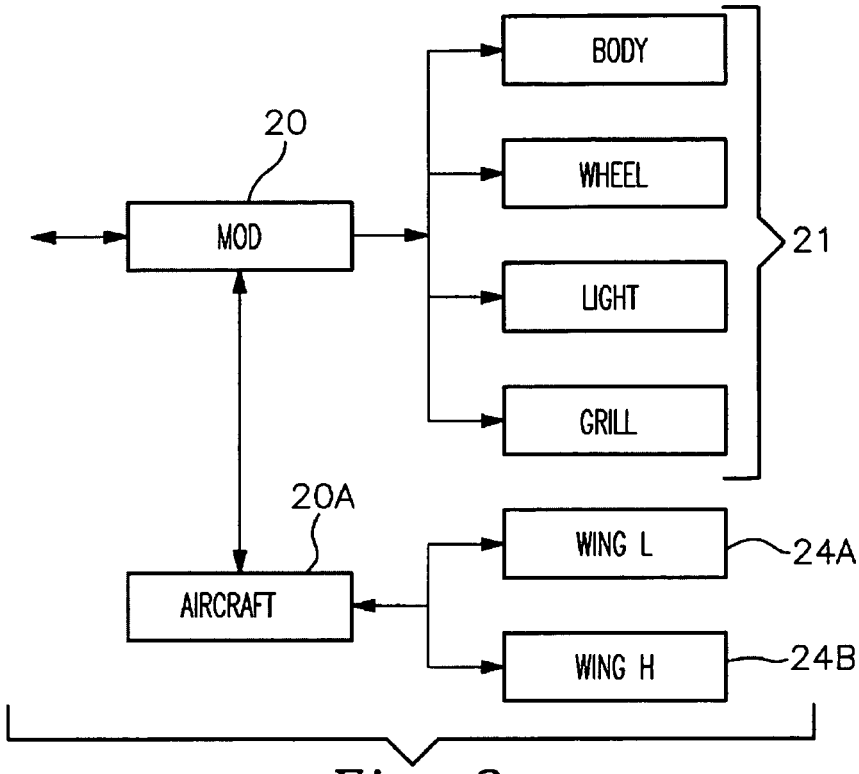
FIG. 2 is a continuation of the block flow diagram of the vehicle selection and modification continuation from FIG. 1, according to an embodiment.

Referring now to FIG. 2, examples of parameters that may be modified at 20 in the basic models 13 include body design, wheel design, exterior color, light design, grill design, license plate design, exterior ornamentation, wing, tail and fuselage geometry and location for aircraft 20A, front spoiler design, roll bars, hoods, and vents generally indicated at 21 in FIG. 2 of the drawings for land vehicles. By customizing various parameters of the vehicle and multiple combination of changes that may be made, it is evident that numerous and distinct vehicles may be created beginning with a single basic model. The software component of the inventive concept may further comprise the ability to calculate relevant properties of a model that has been modified and designed by a user. This ability will provide the user objective criteria for determining whether the designed vehicle is likely to succeed as a working model. In the example of a model airplane, properties that are calculated for a user include the center of gravity locations, center of lift location, total weight, total lift, wing loading and other relevant properties. The software 10 may also inform the user when problems may arise in a working model such as cases where a model plane may have insufficient lift or thrust or have unsuitable configuration. Examples of relevant parameters in a model car including a drag co-efficient, center of gravity, maximum speed and total weight, software known in the art can perform such functions. An example of one such software is commercially available from Gyles AeroDesign software.

In an embodiment, the software can allow the user to design custom vehicles 13 and will provide feedback to the user during the design process regarding potential problems with the design.

An example of multiple operations of a typical design interface will be structured as follows.

1. The user selects the type of vehicle at operation 22 he or she wishes to design and an array of photographs or drawings to illustrate the various vehicles 13A-E types can be presented to the user.

2. Once the user selects the preferred vehicle type, the selected vehicle will appear on a screen, in this example in a perspective view at operation 23. The user can be able to rotate R the view of the vehicle so that the vehicle can be viewed from all angles.

3. The user will be able to select a particular part at operation 24 of the vehicle that he would like to modify and when that portion is selected, various dimensions will appear on the screen at operation 25 that define the shape and location of the selected part.

4. The user can select the dimension he wishes to modify at operation 20 and be able to select alternate choices presented to him for that dimension. For example, (an aircraft) the user may choose to modify the length of the wing 24A or tail 24B and be given two alternate length dimensions therefore or the user may choose to modify the location L as to height of the wing 24A and can be provided with multiple alternate height dimensions for the wing 24A from FIG. 3. Instead of discrete choices, depending on the configuration of the software being implemented, the user can also be allowed to adjust dimensions of parts non-discretely (e.g., at whatever dimensions the user prefers without being presented with particular choices).

5. Referring back to FIG. 1 of the drawings, once the user selects the desired dimensions as modified at operation 20, the revised vehicle design 26 will be displayed along with notes at 27 that would point out a potential design problem if so detected. For example, the user may increase the length of the wing and a message could appear indicating that the plane would be too heavy to fly with the current motors. The computer provides this information based on a database that is compiled by building and testing multiple configurations of the vehicle. If a certain geometry selected by the user will not fly, then the user is notified before they waste time building the model.

Design suggestions at operation 28 can also be provided to the user to help eliminate whatever design issue may have been created by the design change. If for example the wing is lowered, a suggestion could be made considering increasing the wing dihedral in order to improve the aircraft stability. Or if the wing is too heavy, for example, when it is lengthened, a suggestion could be made to add additional motors.

7. Once the design geometry is finalized at operation 29, the user will be able to customize the paint 30 and pattern and decals on the vehicle.

8. When the vehicle paint and decals are finalized, the user will save the design and then print-out at operation 31 the flat patterns for fabricating the design.

Figure 3:
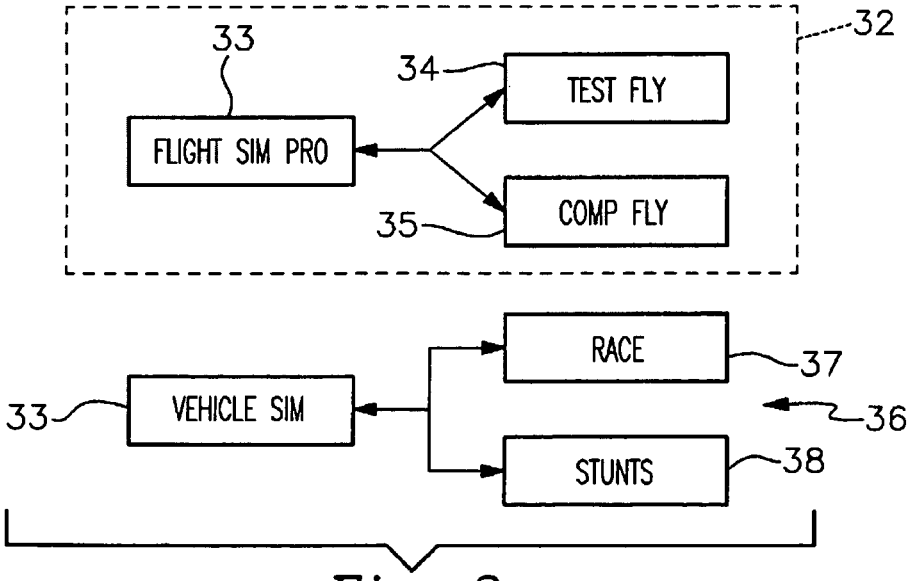
FIG. 3 is a block flow diagram of the vehicle software driven flight simulation flow step diagram, according to an embodiment.

Referring now to FIG. 3 of the drawings, a first alternate embodiment 32 of the present invention is directed towards designing model airplanes in accordance with the invention having flight simulation program software 33. Said software programs 33 allow the user to test fly at 34 an airplane he designs using a visual interface on the computer prior to constructing the airplane. The program will also allow the user to compete at operation 35 with other virtual airplanes (either on a single computer or on networked computers) in races or other competitions factoring in relevant model parameters. It will be evident that the performance of the user's model and simulation competition will be based on calculations made by the program involving relevant model parameters.

A second alternate embodiment at 36 of the present invention is directed towards designing in accordance with the invention having simulation software that allows for virtual races at operation 37. The performance of the user's design car model as previously described may be based on the relevant model parameters factored by the software program.

Additionally, stunts 38 such as jumps or loops to be performed by the simulated model vehicle so designed may be tested out on simulation software prior to the actual construction of the vehicle saving unnecessary time and effort in construction of the models if in the virtual forms the models do not meet the objectives of the users.

It will be evident that an internet website can be developed to provide a community of model enthusiasts a venue for practicing the present invention.

Figure 4:
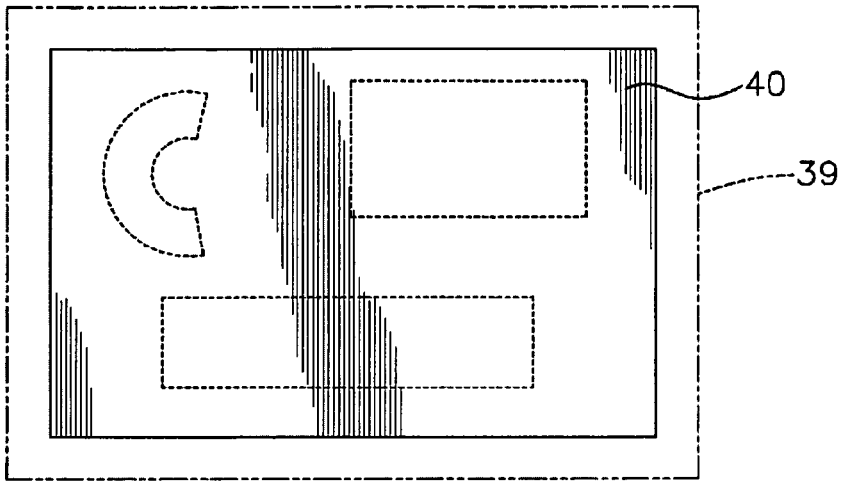
FIG. 4 is a top plan view of a primary form printed template cut-out for the fabrication of a toy model, according to an embodiment.
Figure 5:
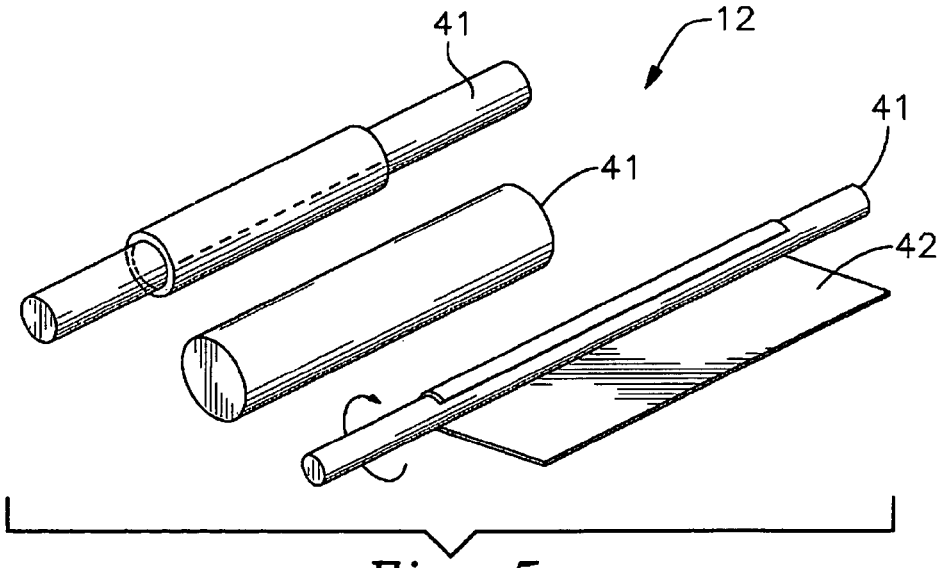
FIG. 5 is an enlarged perspective view showing formation tools and fabricated elements, according to an embodiment.
Figure 6:
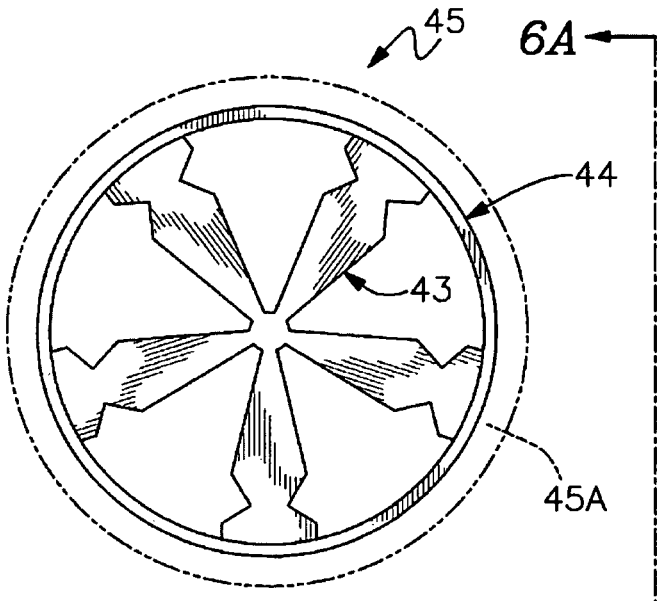
FIG. 6 is a side elevational view of a fabricated wheel showing portions in broken lines, according to an embodiment.

Referring back to one embodiment of the invention in FIGS. 4-6 of the drawings, it will be seen that the print-out through commercially available printers P of flat patterns 39 are provided to represent basic models 13. The user may modify the ornamentation and artwork of the flat patterns using programs such as COREL PHOTO-PAINT, ADOBE PHOTOSHOP and MICROSOFT PAINT. Once modified, the flat patterns are printed out at 40 enabling the user to cut out and assemble a shell for the paper model 13 utilizing applied glue.

By using 3-D software 10B of the invention, the user, as noted, will use a modeling program to develop a physical form for the paper model 13. Examples of other 3-D CAD software available include SOLID WORKS, GOOGLE SKETCHUP, PRO ENGINEER, and 3D STUDIO MAX.

By using 3-D software 10B provides a user a way to make changes to models that are easily and rapidly visualized. The 3-D software 10B will also allow the user to adjust the colors and/or artwork on the exterior surface of the three-dimensional model as hereinbefore described.

When a user has completed the design of a model using the 3-D software 10B, the software component of the present invention can transform the three-dimensional data into a flat pattern. A flat pattern generating algorithm can produce the two-dimensional flat pattern 39 for printout at 40. By creating a two-dimensional flat pattern 39, the user is able to construct an actual model that has been designed and viewed by the user practicing the three-dimensional software 10B. An example of flat pattern generating software is Pepakura Designer available from Tama Software.

The flat patterns 39 are printed at 40 on a substrate that may be accepted by a printing device, preferably paper. Other thin foldable printable material may be used, such as stickers, thin film, plastic film, aluminum foil, etc.

Once a pattern is printed at 40, the user may trim the excess material lying outside of the pattern during the fabrication process. The paper may be coated with a suitable material to increase durability and resistance to elements such as water and wind. A water vehicle can be coated with a special coating (e.g., rubber based liquid) in order to protect it from sinking due to absorption of water. Another material can be used is DEFT, a spray on coating that can be used like a varnish or plastic to waterproof the boat.

Referring now to FIGS. 5 and 6 of the drawings, the tools 12 for construction of the remote control model vehicles 13 can be seen. Such tools 12 and parts for enabling the user to construct model vehicles 13 from the flat patterns 39 and remotely powering them.

Figure 6A:
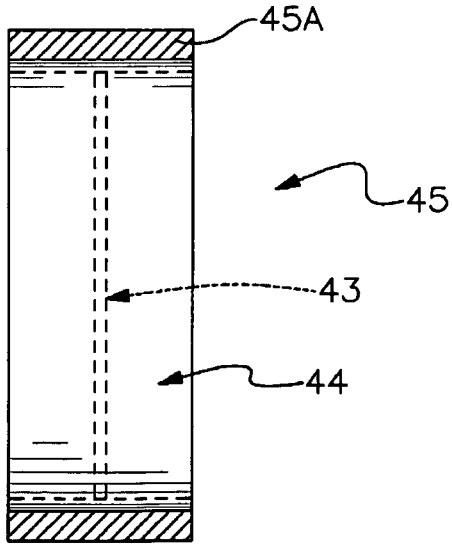
FIG. 6A is an end elevational view on lines 6-6 of FIG. 6A, according to an embodiment.

Referring now to FIG. 5 of the drawings, multiple rolling tools 41 that may be used for rolling various pieces of material into tubes having different circumferences and lengths is shown. The rolling tools 41 are used to construct parts, such as axles 42, axle casings and wheels. Combining the axles 42, axle casings, axle housings, axle bushings, wheel spokes, interwheel piece 43 and outer wheel piece 44 as seen in FIGS. 6A and 6B of the drawings, a working paper wheel assembly 45 of a model vehicle 13 can be constructed. In such a situation where a paper wheel is constructed, a non-paper surface may be desirable (e.g., rubber or foam 45A) which can be used to form the tread portion on the wheel in order to increase traction. Alternately, a coating of rubber cement (not shown) may be applied to a paper wheel 45 to achieve the same purpose.

Figure 7:
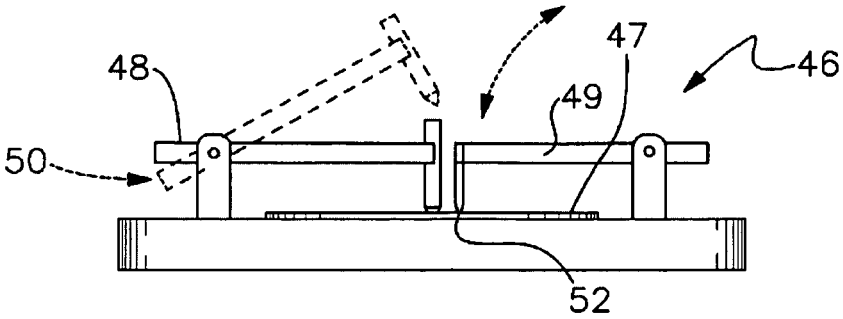
FIG. 7 is a side elevational view of a ring fabrication tool, according to an embodiment.
Figure 8:
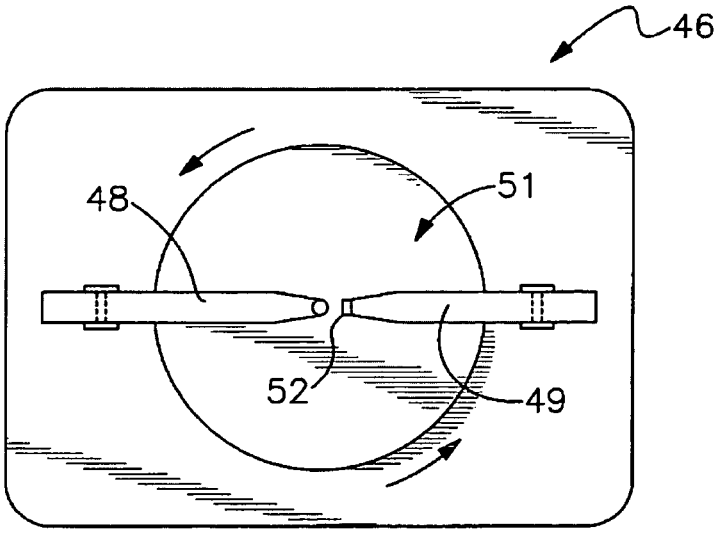
FIG. 8 is a top plan view of the ring fabrication tool, according to an embodiment.

The kit of the invention further comprises a ring tool 46 illustrated in FIGS. 7 and 8 of the drawings. The ring tool 46 may be used to cut various size rings in the construction of models. Axle bushings and wheel rings are examples of parts that are constructed by the ring tool. The ring tool 46 comprises a rotatable table 47 positioned of multiple arms 48 and 49. The arm 48 comprises a weight, spring 50 and other mechanism to provide pressure to hold down a sheet of paper 51 in place. The second cutting arm 49 comprises a blade 52 or other cutting edge on its free end. The cutting arm 49 is adjusted so that rings of different sizes may be cut.

Figure 9:
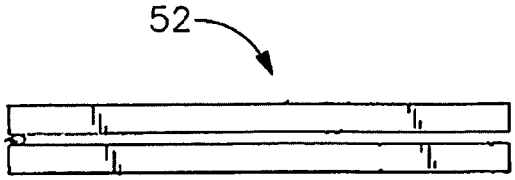
FIG. 9 is a perspective view of a bending tool, according to an embodiment.

Referring now to FIG. 9 of the drawings, a folding tool 52 is shown which is used to fold various pieces derived from flat patterns 39 which are printed from the software component of the kit into shapes to make up part of the model 13. These shapes may be closed shapes that perform specific tasks such as axle housing or body of a model. Multiple notches 53 in the folding tool 52 allow for precise adjustment of a bladed compass used to cut exact wheel rings. The folding tool 52 is described in greater detail in the '391 patent.

Figure 10:
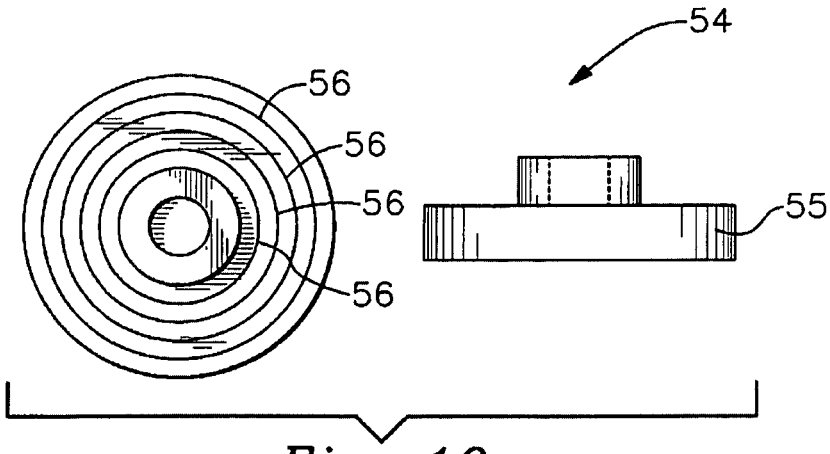
FIG. 10 is a combination side elevation and top plan view of an alignment ring fabrication tool, according to an embodiment.

Referring now to FIG. 10 of the drawings, an alignment tool 54 is illustrated which aligns the inner and outer wheel pieces hereinbefore described so that they may be attached to two wheel rings making a complete wheel. The alignment tool 54 comprises an annular disk 55 configuration having a series of annularly spaced material engagement grooves 56 so as to provide multiple size retainment and positioning of fabricated elements to be constructed.

Figure 11:
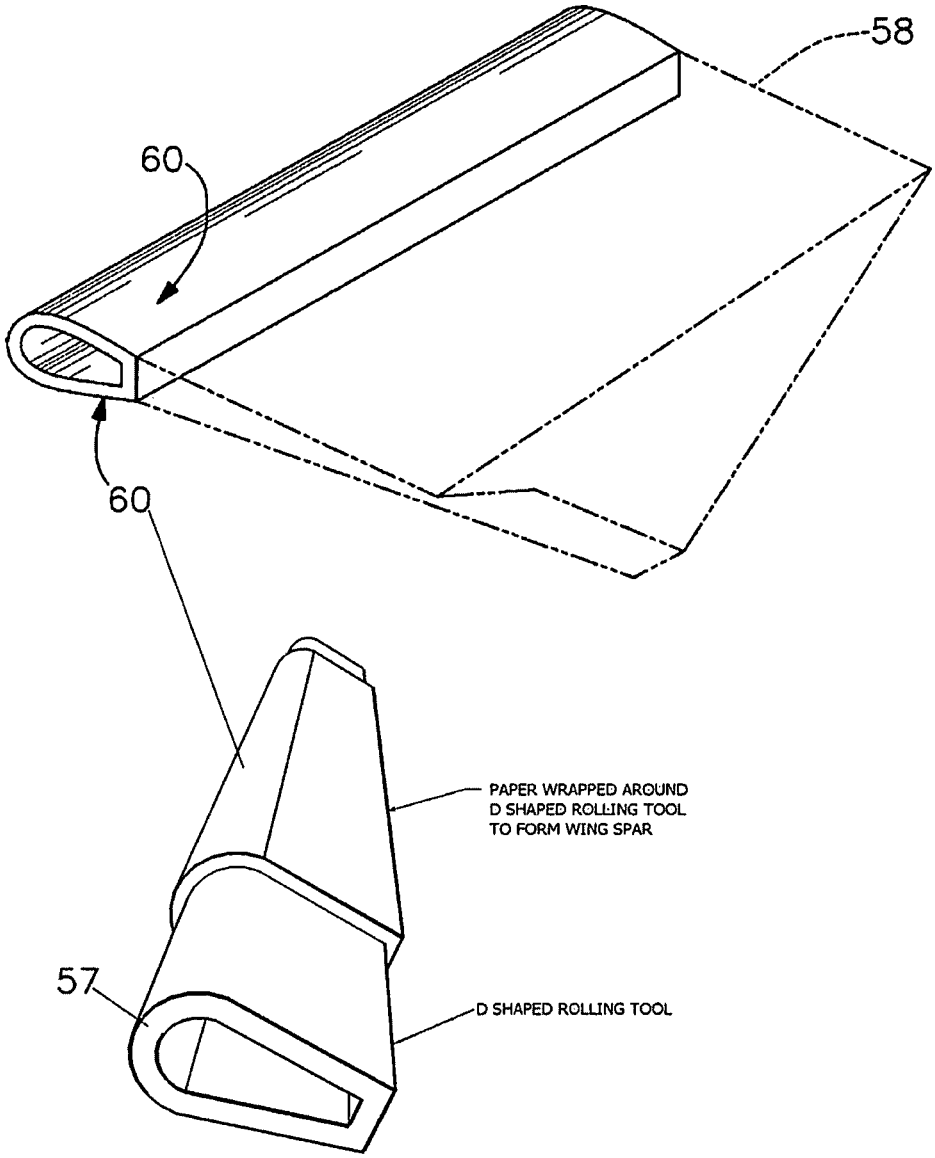
FIG. 11 is a perspective view of a wing formation tool, according to an embodiment.

Referring now to FIG. 11, the wing forming tool 57 is a "D" shaped tool which can be made of plastic which is used to form a wing spar 60 for a wing 58. The wing spar 60 is a tubular reinforcement inserted inside an end portion of the wing 58 as shown in order to provide support and reinforcement for the wing 58. The wing spar 60 is formed by wrapping paper around the wing forming tool 57 to form and shape the wing spar 60, and then gluing ends of the formed wing spar 60 together. The wing 58 is then wrapped around the wing spar 60 and can be glued to it. The wing forming tool 57 can be removed after the wing is completed. The wing forming tool has a "D" shaped cross section to help form and define the wing shape.

Figure 12:
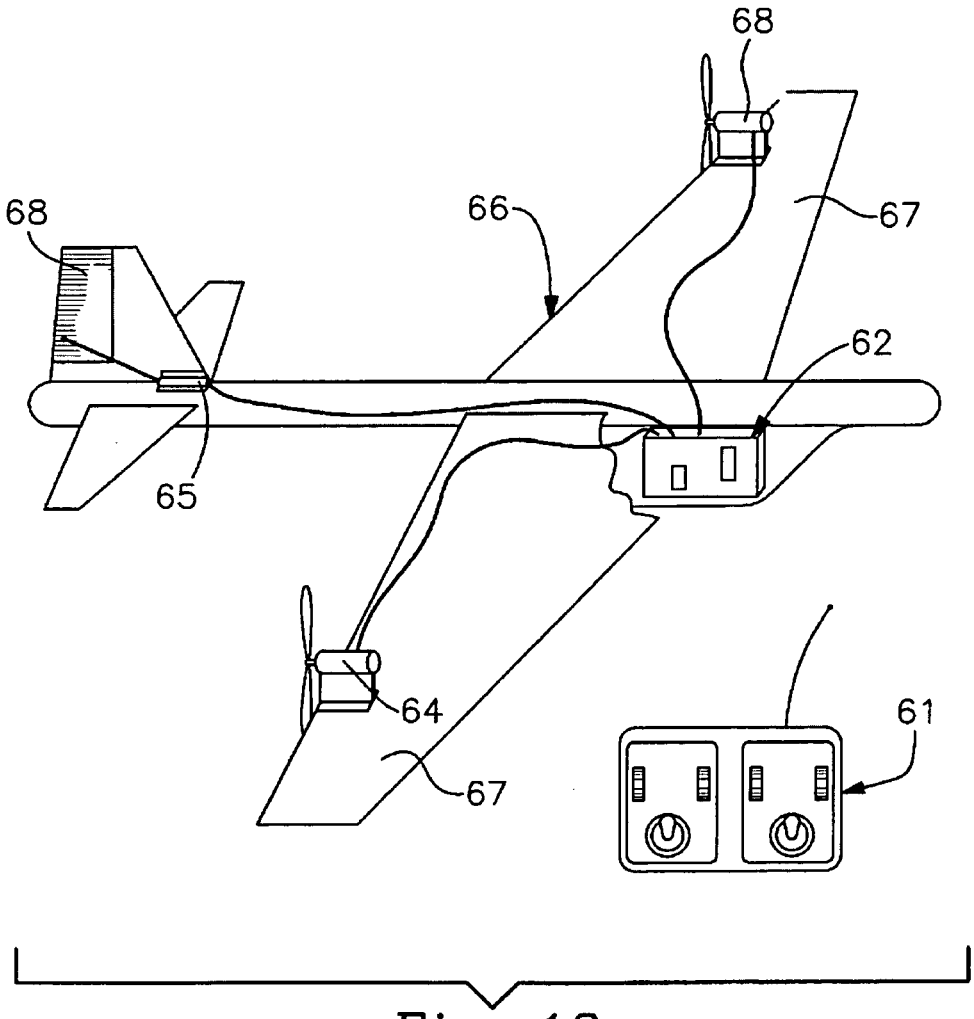
FIG. 12 is a modified perspective assembly view of a model airplane constructed using a kit, according to an embodiment.

Referring to FIG. 12 of the drawings, the kit of the invention comprises at least one remote control transmitter 61 and at least one remote control receiver 62 and at least one flat pattern 39 shown in FIG. 4 and motor. A processing unit is attached to the remote control receiver 62 that processes received signals and generates actual currents which pass through wires connected to motors (or other electrically operative devices on the toy), the current level based on the received signals.

A controller can comprise the receiver, power supply, and processing unit, such that the controller is connected to motor (s) on the toy and sends desired power levels to each respective motor(s) using wires.

An example of same can be seen wherein a model airplane 66 made in accordance with the kit of the invention in which a three channel transmitter 61 provides a radio signal to a receiver 62 which can help with the turning and the speed of the incorporated model configuration. In this example, motors 64 with attached propellers are positioned on the front edge and back edge or other locations of wings 67 of the model airplane 66. A tail control actuator 65 is used to assist in the turning of the airplane via its rudder 68 (a steering device) which is well known and understood within the parameters of model airplane control.

In a further embodiment, there is no rudder or rudder actuator/motor. Instead, steering of the airplane is accomplished by using differential thrust of the two motors located on the right and left side of the airplane. A left turn is accomplished by reducing the power to the left motor 68 in comparison to the power to the right motor. A right turn is accomplished by reducing the power to the right motor 64 in comparison to the power to the left motor. A controller on the airplane (or other air vehicle) can control the differential thrust (e.g., power to both motors). Thus, the airplane can use the same motor(s) and receiver as is used in other vehicles such as a car, boat, hovercraft. The controller can comprise an antenna, a receiver and a power supply. Motors can be attached to the power supply using wires.

The controller of the present inventive concept can allow the user to run either motor in both forward and reverse. This feature is important for RC cars, in order to control the car to go forward, reverse, and steer the car left and right. The RC transmitter can have the ability to switch from airplane mode to car mode or boat mode by using a switch. The switch is used to select a preferred operational mode for controlling the airplane, hovercraft, boat or car The airplane mode can have reduced steering sensitivity (differential power) compared to the car mode, and can also allow one motor to rotate forward and one motor to rotate in reverse for car mode or boat mode.

Figure 13:
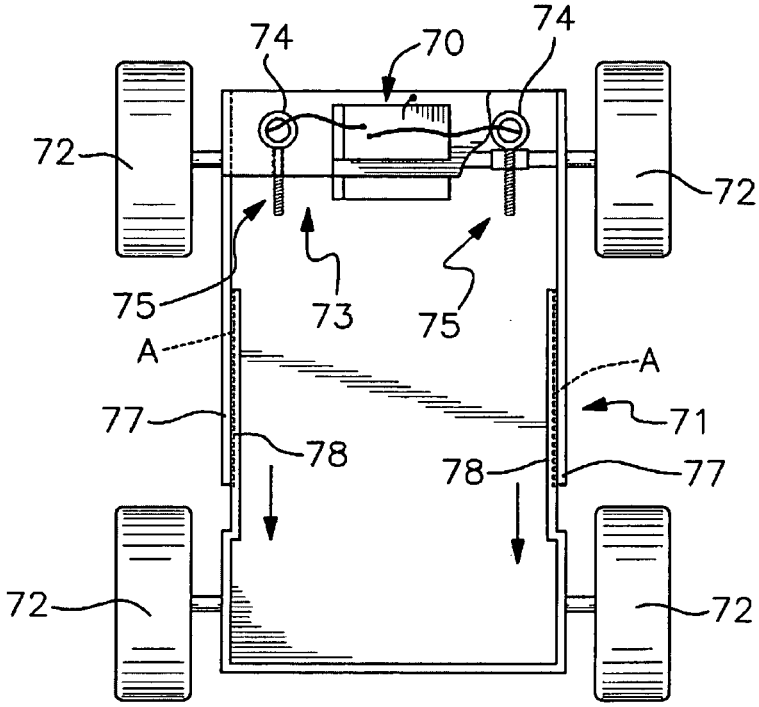
FIG. 13 is a top plan view of an interchangeable modular drive and remote contact drive and power steering expandable modular car frame with mechanism, according to an embodiment.
Figure 14:
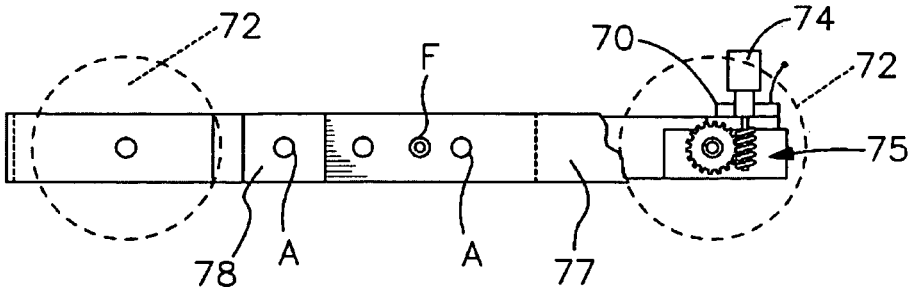
FIG. 14 is a side elevational view of the interchangeable modular drive and remote contact drive and power steering expandable modular car frame with mechanism, according to an embodiment.

Referring now to FIGS. 13 and 14 of the drawings, a vehicle configuration 69 is illustrated in which an axle and drive and power supply 70 for a model car 71 can be seen. Although the front wheels are shown on a fixed axle in the drawing, improved steering can be achieved by using a caster wheel connection or a conventional steering linkage for improved turning ability (a steering device). Paper (or plastic) wheels 72 with an axle collar can be attached to a plastic drive transport assembly 73 with electric motors 74 and gear assembly 75. In FIG. 13, the right and left axles are driven independently, and the right motor drives the right wheel and the left motor drives the left wheel. In this embodiment, there is no steering linkage.

The model car 71 can have an adjustable length chassis. This can be accomplished in numerous ways such as using a telescoping chassis with offset interengagement aligned aperture side rails 77 and 78 that are selectively fastened to one another by fasteners F. The goal of the telescoping length chassis is to allow car models with different length to width ratios to be built using the same chassis. This can also be accomplished with a chassis that has a separate front and rear axle assembly where the front and rear are connected by the paper model.

Figure 15:
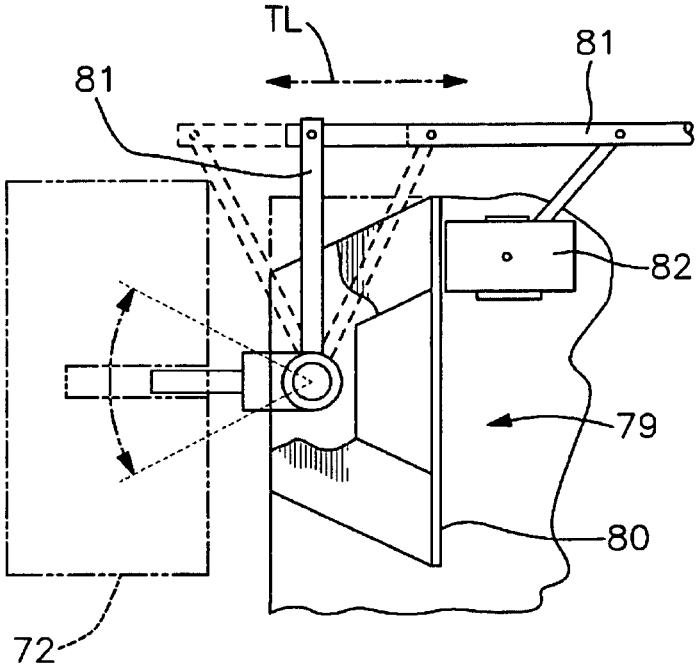
FIG. 15 is an enlarged partial top plan view of a remote steering modular assembly supplemental insert, according to an embodiment.

Referring now to FIG. 15 of the drawings, a wheel turning assembly 79 for vehicles 13 of the invention can be seen in which plastic insert axle wheel support 80 are supplied and connected to fabricated paper or plastic tube linkage and armatures 81. A remotely controlled motor 82 imparts translateral movement to the associated linkage indicated by directional arrow TL which in turn pivots the assembly elements shown in broken lines onto which the fabricated wheels 72 are rotatably retained.

As illustrated in the drawings, there are a multitude of vehicle types having countless shapes, forms and designs and ornamentations that can be created using the same basic elements as hereinbefore described. Such elements include the same actuators, motors, receivers and transmitters that may be used to control and provide motion to a car, boat, plane or other vehicle. Thus, the user is afforded endless design possibilities from a single kit.

The kit can comprise the remote control transmitter, car chassis, propellers, tools, and software. The kit can also comprise a controller which can comprise a power supply, receiver, and processing unit. It will thus be seen that a custom remote control design and fabrication kit of the invention has been described. The kit of the invention includes, but is not limited to the formation and fabrication tools 12, adhesives, and applicators associated therewith, the transmitter 61, receiver 62, motors 64, drive gear assemblies 73, printed model fabrication patterns 39, integrated software 10A and 10B for model selection and real-time modification in both two and 3D configurations as well as internet communication access.

It will be evident from the above description that the utilization of remote control elements involves the adaptation of components dependent on integration use requirements for control as to turning, throttle and directional all well known and understood by those skilled in the art.

It will be seen that a primary alternate form of the invention kit can be achieved wherein pre-printed and/or precut and/or prescored flat paper patterns 39 are supplied without the requirement for use of the computer assisted design software 10 hereinbefore described. Such a model kit can use the same fabrication tools 12 utilizing a selection of pre-printed paper templates 40 with pressure sensitive adhesive pre-applied corresponding to basic model structure fabrication elements that could be mixed and matched by the user manually to achieve a variety of different model vehicle configurations within pre-determined model type sets pertaining to land, water and air vehicles.

Such design selection would use, for example, the hereinbefore described pre-assembled drive and control modules including interchangeable motors 64 and 74 drive transport assemblies 73 and remote control transmitter 61 and receiver actuators 62 and 65 respectively.

Figure 16:
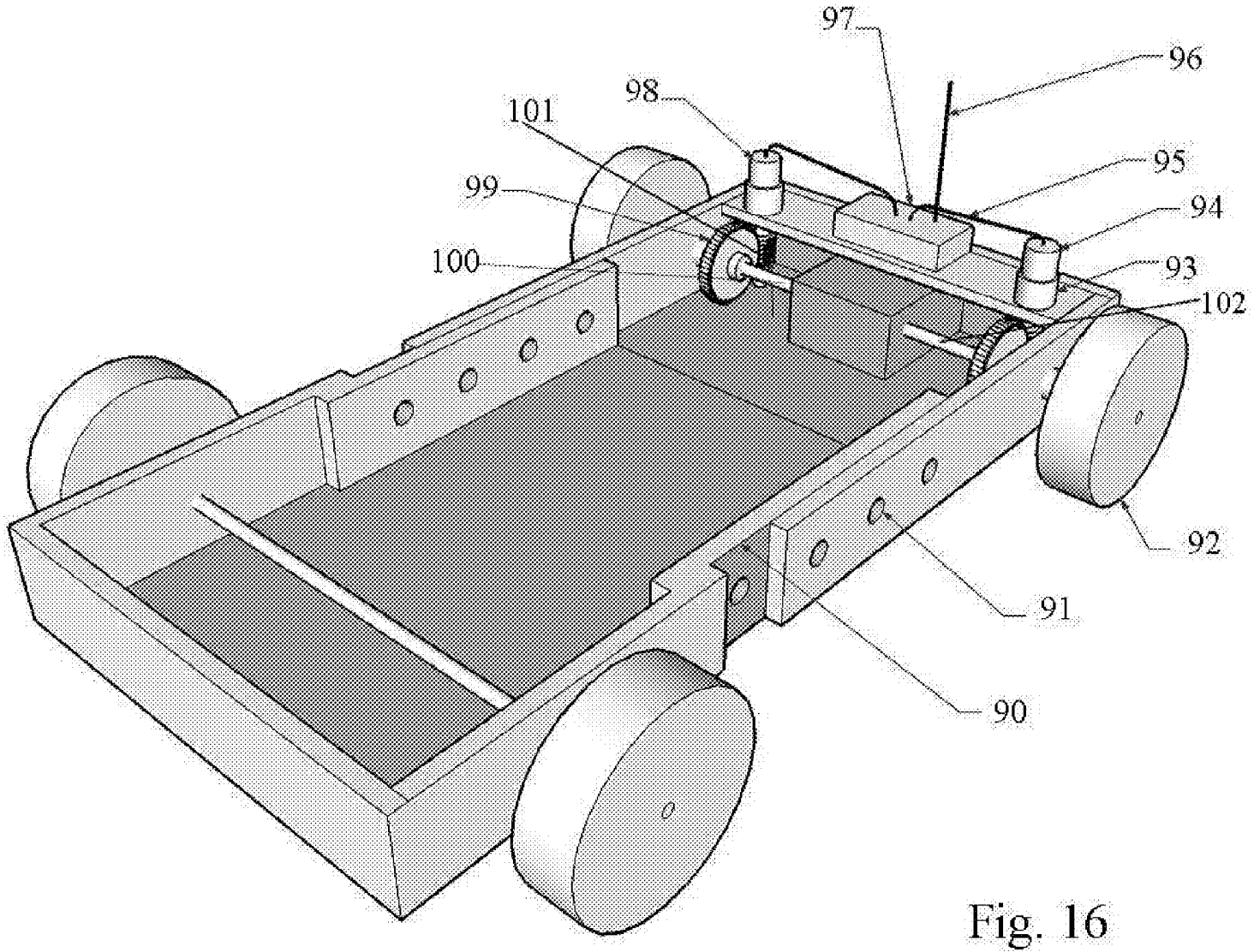
FIG. 16 is a perspective view of a telescoping chassis, according to an embodiment.

FIG. 16 is a perspective view of a telescoping chassis, according to an embodiment. A telescoping front chassis 90 can telescope in order to adjust its length to fit a particular sized body made out of paper. A fastener hole 91 can be used to place a fastener or snap (not pictured) through in order to secure the telescoping front chassis 90 at a particular length. A left wheel 92 is one of four wheels which actually turn to propel the toy car. A chassis can have an adjustable length using other mechanisms than telescoping, for example the chassis can utilize a scissors linkage or nut and screw connection, etc. The front chassis may have fixed axles, or it may employ a four bar linkage connected to the wheels that allows the wheels to pivot for improved turning capabilities.

A left motor housing 93 is used to house a left motor 94. The left motor 94 can be removable and can be inserted inside the left motor housing 93. The motor can be secured to the housing by friction or by keying the motor and housing or with a set screw to prevent rotation of the motor within the housing.

The left motor 94 can also be used to propel other toy vehicles as well, such as a hovercraft, plane, boat, etc. A power wire 95 is used to connect each motor to a controller, which can comprise a receiver, power supply, and processing unit. The processing unit can be a microprocessor unit and/or amplifier(s) in order to receive signals from the receiver and output respective power levels to the motors.

An antenna 96 is used to receive signals from a remote control unit (not pictured in FIG. 16) which is used by an operator to control the car (e.g., steer, go forward or reverse, adjust speed, etc.) A right motor 98 is another motor used to propel the toy car. The right motor 98 is in communication with a spur gear 99 that is connected to a rear axle 100 thereby turning the rear right axle 100 and moving the car forward. The left motor 94 is configured similarly to the right motor with identical respective components (such as the spur gear, etc.) and can turn a rear left axle 102 which can spin independently of the rear right axle 100. Alternatively, both the rear left axle 102 and the rear right axle 100 can really form a single rotating axle.

The chassis can use the same controller (e.g., power supply, receiver, processing unit) that is used for the other vehicles (e.g., airplane, boat and hovercraft) to connect the motor(s) to each of the rear wheels on the chassis can be powered independently with its own electric motor. A gear reduction consisting of a worm and spur gear is shown; however other types of gear reduction may also be employed. A right rear axle and a left rear axle can turn independently of each other. The motors can be plugged directly into the worm gears via a center hole in the worm gears that fit tightly to the motor shafts. The power module and motors are removable so they can be used to power other models. The power module may be attached to the chassis with VELCRO or a removable adhesive (e.g., tape, glue) or a spring clip.

The adjustable length chassis allows vehicles to be custom designed and constructed with different length to width ratios and to be mounted securely on the chassis. Thus, the single adjustable length chassis can be used for long toy vehicles (e.g., a school bus), or a short vehicle (e.g., a helicopter or car, etc.) Once the vehicle body is constructed, the user should then adjust the chassis as he or she sees fit to the proper length and then attach the vehicle.

Figure 17A:
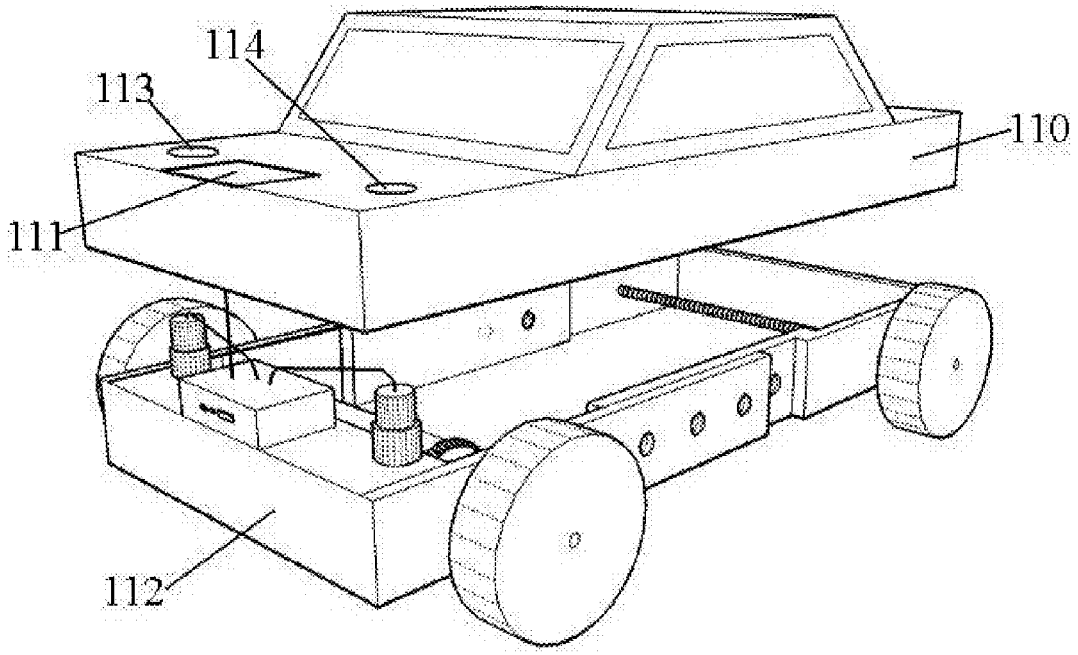
FIG. 17A is a perspective view of a separate vehicle body and chassis, according to an embodiment.

FIG. 17A is a perspective view of a separate vehicle body and chassis, according to an embodiment. A vehicle body 110 is constructed out of paper, or any other thin substrate, which is folded and/or cut and/or glued accordingly to form the vehicle. A chassis 112 is a preformed structure which can be included in the kit and can be made out of plastic, metal, wood, or any other structural material. A power supply opening 111 is an opening in the vehicle body 110 in order to accommodate the power supply 115 (see FIG. 17B). A left motor opening 113 is an opening in the vehicle body 110 in order to accommodate the left motor 116 (see FIG. 17B). A right motor opening 114 is an opening in the vehicle body 110 in order to accommodate the right motor 117 (see FIG. 17B).

Figure 17B:
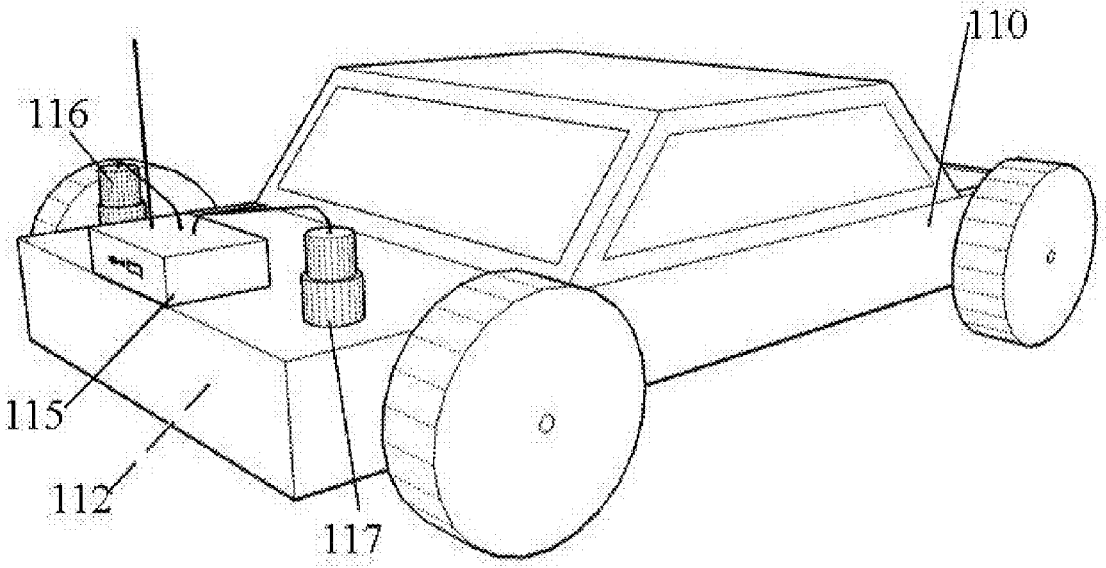
FIG. 17B is a perspective view of an attached vehicle body and chassis, according to an embodiment.

FIG. 17B is a perspective view of an attached vehicle body and chassis, according to an embodiment. The vehicle body 110 is attached to the chassis 112. The attachment can be effectuated by a simple friction fit, or a weak adhesive can be used so that the vehicle body 110 can still be easily removed from the chassis 112 (shown as a dashed line since the chassis is actually hidden behind the vehicle body 110) when an operator wishes to use the chassis (and parts therein such as the motor(s), etc.) in another vehicle. A power supply 115 provides power to operate the left motor 116 and the right motor 117, both motors of which turn (an axle, or a right axle and left axle) (not pictured) which turn the wheels, thereby moving the car. The motors can be connected to the power supply 115 through a processing unit (not pictured) which regulates power to each motor.

Figure 18:
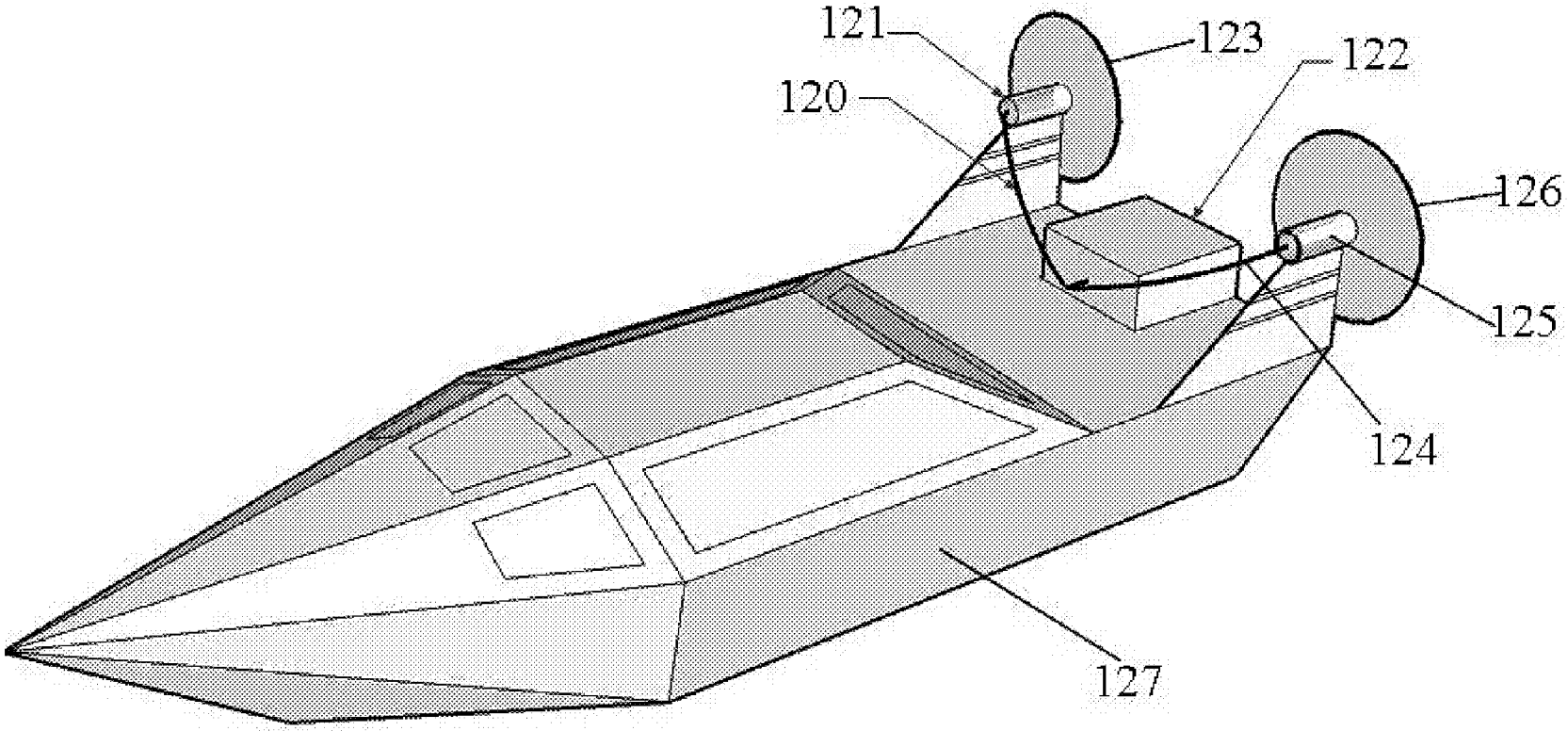
FIG. 18 is a perspective view of a boat constructed using the methods described herein, according to an embodiment.

FIG. 18 is a perspective view of a boat constructed using the methods described herein, according to an embodiment.

A boat body 127 is designed, printed, and constructed using paper as described herein. The boat body 127 is attached to a power supply 122 which provides power to a right motor 121 through a right power wire 120. The power supply 122 provides power to a left motor 125 through a left power wire 124. The right motor 121 turns a right propeller 123 while the left motor 125 turns a left propeller 126. The propellers 123, 126 can either be constructed out of paper or can be pre-fabricated (out of plastic, paper, etc.) and provided inside the kit. The right motor 121 and the left motor 125 can clip onto the boat body 127, or can attach using any other attachment mechanism (adhesive, friction, etc.)

The boat can turn using differential force (thrust), that is, each motor can be provided with a different amount of power, thereby allowing one motor to turn faster than the other motor, turning the boat. Not pictured in FIG. 18 is a receiver to receive wireless signals from a remote control allowing a remote operator to control the hovercraft (e.g., forward, reverse, speed, steer, etc.) Alternatively, instead of using differential force to steer the boat, a rudder (not pictured) can be remotely operated to steer the boat.

Figure 19:
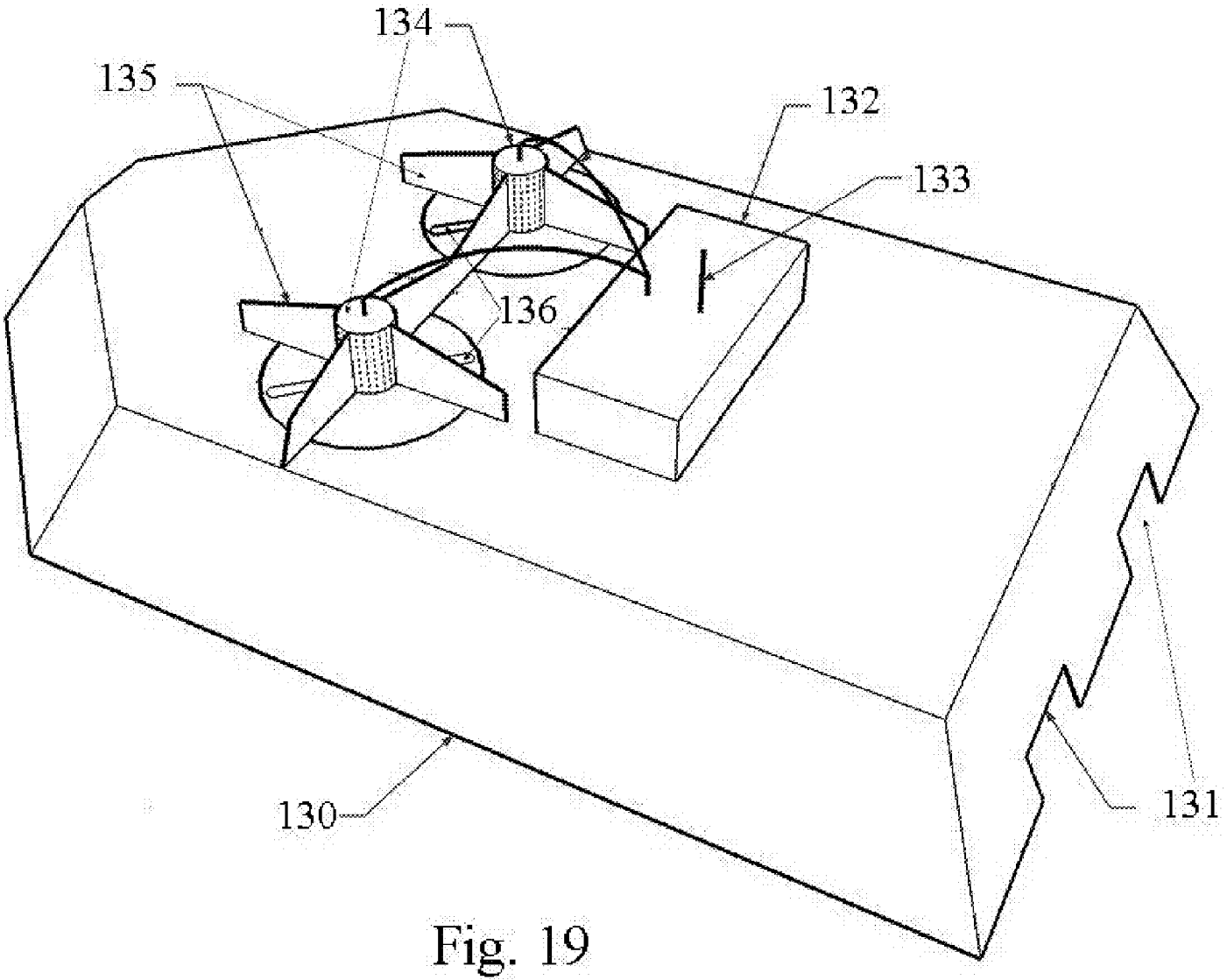
FIG. 19 is a perspective view of a hovercraft constructed using the methods described herein, according to an embodiment.

FIG. 19 is a perspective view of a hovercraft constructed using the methods described herein, according to an embodiment. A hovercraft body 130 is constructed using methods described herein. Exhaust ports 130 are used to direct air out of the hovercraft body 130, thereby propelling the hovercraft body 130 forward. The plenum space inside the hovercraft body is bifurcated so that increasing power to the left motor increases air flow out of the left exhaust port and increasing power to the right motor increases air flow out of the right exhaust port.

An antenna 133 receives signals from a transmitter (not pictured) and communicates them to a receiver (not pictured) in order that the hovercraft can be controlled (steered, moved forward, powered on/off, etc.) controlled. Motor supports 135 are part of the hovercraft body 130 which are used to house motors 134 which turn propellers 136. The motors are controlled by a controller which allows the hovercraft to be controlled and steered remotely using the transmitter.

Figure 20:
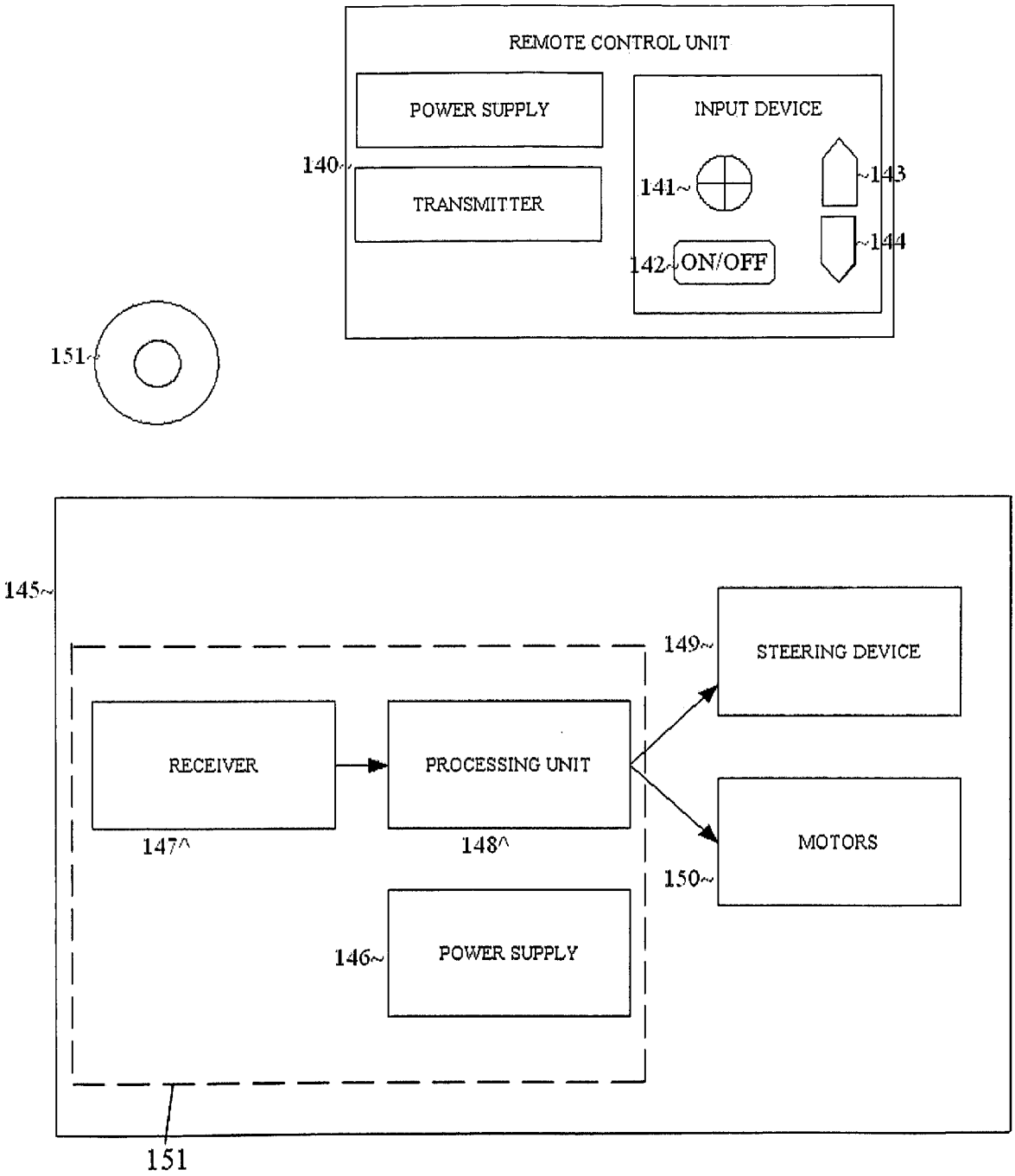
FIG. 20 is a block diagram showing components in a toy vehicle kit, according to an embodiment.

FIG. 20 is a block diagram showing components in a toy vehicle kit, according to an embodiment. This is a logical diagram and is not intended to depict physical locations or structures of the components. The kit can comprise all of any combination of these components.

A remote control unit 140 comprises a power supply, a transmitter, and an input device. The remote control unit 140 can also comprise a vehicle selection switch and associated circuits. The input device can, for example, comprise a steering wheel 141 to remotely steer a vehicle left/right and optionally up/down (if the vehicle is an air vehicle). An on/off button 142 can be used to remotely turn the vehicle on and off. A throttle up button 143 and a throttle down button 144 can be used to adjust the speed of the vehicle. Of course, these controls are merely exemplary, and any configuration of input mechanisms can be used to remotely control a toy vehicle. Not pictured on the remote control 140 is an optional forward/reverse switch to control the vehicle into going forward and reverse. In another embodiment, the remote control can have two joysticks. The left joystick is the power joystick and the right joystick is the direction control joystick.

A computer readable storage medium 151 such as a CD-ROM, DVD, etc., can be used to store software to perform the automated operations as described herein. Such software can also be downloaded from a computer communications network such as the Internet. Information or instructions on how an operator (user of the kit) can remotely retrieve the software over the Internet (as opposed to including a computer readable storage medium) can be included in the kit.

Figure 27:
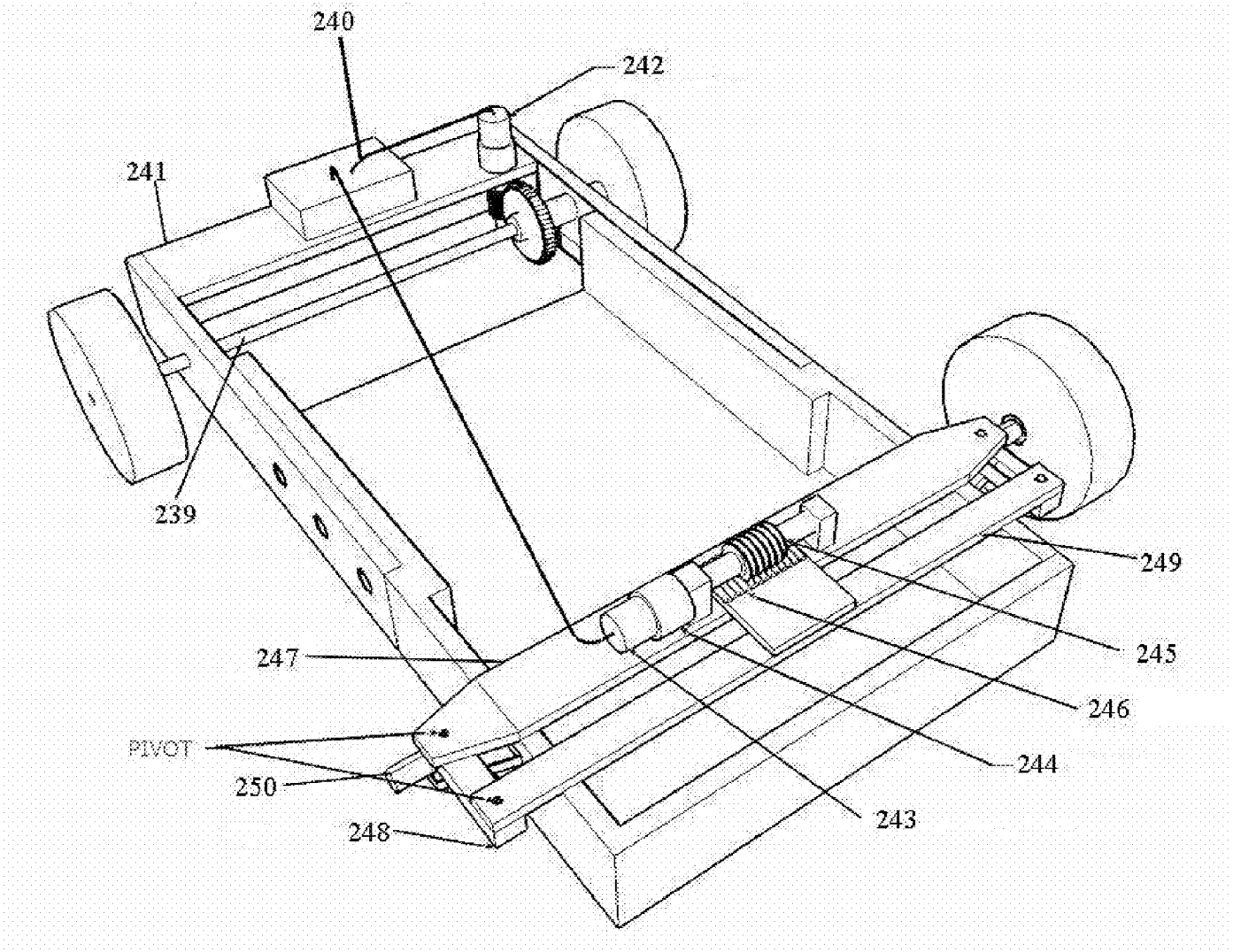
FIG. 27 is a drawing illustrating a steering linkage of a chassis, according to an embodiment.

A power supply 146 is used to provide power to any component herein (the connection to all components is not shown in FIG. 20 but it is inherent). The power supply 146 can be a standard or rechargeable battery. The power supply can also be a housing or compartment to receive a battery (e.g., it is not necessary for a battery to be included to be considered a power supply). A receiver 147 is used to remotely receive (e.g., not using wires) signals from the remote control unit 140. The receiver 147 is connected to a processing unit 148. The processing unit 148 receives the signals from the receiver and processes those signals appropriately to output respective power levels to motors on the vehicle which control the vehicle according to the received signals. For example, if the operator presses the throttle up button 143 on the remote control unit 140 then the processing unit 148 can increase power to motor(s) 150 (after it receives the signal from the receiver). If the operator steers the vehicle left using the steering wheel 141, then the processing unit 148 can output power to mechanically turn a steering device 149 to turn an axle on the vehicle (if the vehicle is a land vehicle) to the left in order so that the car would turn to the left. The steering device 149 can actually be an additional motor (as illustrated in FIG. 27. One way the processing unit 148 can operate is to receive signals from the receiver 147, and then use a lookup table (or other type of logic circuit) to determine a desired power level (based on the received signal) and respective motor, and then use an amplifier or other device to output the actual power level to a wire connect to each respective motor.

A controller 151 can comprise the receiver, processing unit, and power supply. The controller 151 would be used to receive signals from the remote control unit 140 and output the appropriate power amount (e.g., current) to each individual motor (e.g., 149, 150) on the toy vehicle. Thus, the kit can come with the controller 151 (which may or may not be integrally attached to a chassis) so that the user can simply attach motors to wires attached to the controller 151. The components of the controller 151 (e.g., receiver, power supply, processing unit) may come integrated as one unit (e.g., a box) for convenience, although it may also come in the separate components as well. Different colored wires (or connectors) can be attached to the controller (or the processing unit) so that the user knows which wires (or connectors) to connect to which motors. The same controller 151 can be used interchangeably in different type of toy vehicles (e.g., land vehicles, air vehicles, etc.) made according to any of the methods described herein. Thus, one controller 151 can fit onto or inside an automobile chassis, airplane body, boat body, etc. (all made from a flat pattern). Wires (or connectors) coming out of the controller are attached to their respective motors. Power outputs (or current levels) to the motor(s) from the controller 151 on the toy vehicle can be considered the control output. The user operates the remote control which ultimately results in the control output, which controls the vehicle (e.g., causing it to turn, speed up or slow down, etc.) by changing power (and possibly direction of current flow) to all motor(s) on the vehicle. The same motors can be used in each different type of vehicle that can be created using the methods herein, by attaching them and detaching them as desired.

The steering device 149, depending on the embodiment being implemented, may not be necessary. For example, if an airplane is constructed, the airplane can be steered using differential thrust (as described herein), wherein power levels to different motors can be different, turning the airplane. Alternatively, a moving rudder can be used to steer the airplane, in which the steering device 149 would be needed in order to physically turn the rudder.

The kit can also comprise miscellaneous prefabricated pieces such as propellers 152, motors 153, wires (not pictured) to connect the power supply to the motors, clips (not pictured) to attach motors onto the vehicles, gears 154 (which can be used to connect motors to a threaded axle or other propulsion device), foam wheels (can be made out of foam, rubber, or other material to provide better traction, as an alternative to printing and constructing paper wheels using the kit), and any other part described herein or reasonably needed to operate the invention. These miscellaneous parts can be made out of any suitable material, such as plastic, rubber, etc. The kit can also comprise double sided tape, scissors, springs, steering linkage, tube connectors, airplane landing gear, paper, pre-printed patterns, any of the tools described herein, a waterproof sealer, glue, etc. Flat patterns of vehicle parts can also be included in the kit, the flat patterns may include precut vehicle parts with peel and stick adhesive for easy assembly without needing glue.

Figure 21:
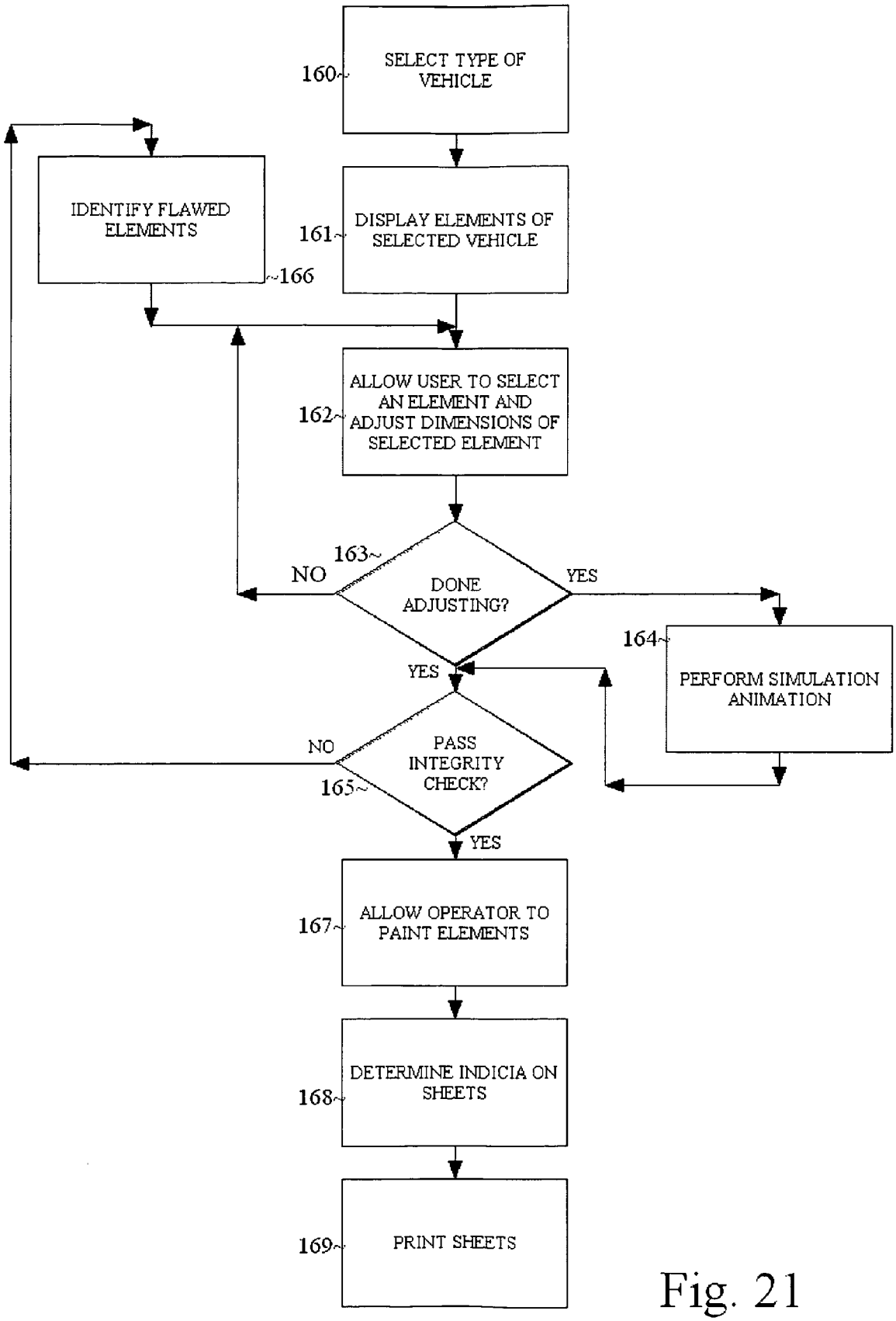
FIG. 21 is a flowchart illustrating an exemplary method of using a modeling program to construct a toy vehicle, according to an embodiment.

FIG. 21 is a flowchart illustrating an exemplary method of using a modeling program to construct a toy vehicle, according to an embodiment.

The method can begin when the operator installs software on the computer readable storage device or from the Internet and runs the software. Then, in operation 160, the operator can select a type of toy vehicle he or she wishes to construct. Available types of vehicles that the operator can choose from can be any combination of a: car, truck, motor boat, hydrofoil, hovercraft, bird, dinosaur, robot, helicopter, propeller powered car, ornothopter, excavator, front end loader, sailboat, and submarine.

In a simple form of the inventive concept, the computer software can then print out predetermined sheets with respective indicia for the selected vehicle without the user having to make any design choices (other than choosing the vehicle type). The user (operator) then using the printed sheets, constructs the toy vehicles as described herein.

In a more flexible form of the invention, the method can proceed to operation 161, which displays different elements of the vehicle. The display can either be done in two or three dimensions. For example, if the vehicle is an airplane, then the elements can be the wings, nose, rail, center, etc.

Note that initial vehicle designs would allow openings for the mechanical components of the vehicle, if necessary. For example, FIG. 17A illustrates a power supply opening 111, a left motor opening 113, and a right motor opening 114. Such openings would exist in the stored elements of the vehicles in order to accommodate such parts of the kit. Thus, once the vehicles are actually printed and constructed, these openings would exist in the toy vehicle.

From operation 161, the method can proceed to operation 162, which allows the user to select an element displayed in operation 161 and adjust dimensions of that element. The user can also have the ability to move the location of that element. For example, the wing of an airplane can be positioned on the body of the airplane forward, aft, up, or down. The user can expand or shrink the size of the element. The user may also be able to freely set the dimensions of the element. In an even more flexible embodiment, the user can use the modeling software to completely redesign the element, including the three dimensional shape.

From operation 162, the method can proceed to operation 163, which determines whether the user is finished adjusting (changing) elements. The user can adjust as many elements as the user wishes (from none to all). The user can indicate to the program that he or she is finished adjusting elements. If the user is not done, then the method can return to operation 162, which continues to allow the user to select elements and adjust (or redesign) them.

If in operation 163, the user is done adjusting the elements, then the method can proceed to operation 165, which performs an integrity check on the vehicle with the changes the user has made. Based on the changes the user has made, the vehicle may not operate properly. For example, if the vehicle is an airplane, and the dimensions of the wings are too small, the airplane will not fly stably. If the modified vehicle does not pass the integrity check in operation 165, then the method can proceed to operation 166 which identifies to the user why the vehicle would not would work properly (e.g., the problem may be related to inadequate power or balance). To provide entertainment for the user, an animation can be presented to the user of the vehicle and what would happen if it were to be constructed. For example, the animation can present the faultily designed airplane which will then fly and crash. The program can also display to the user corrected dimensions or designs for each of the elements which cause the design to fail the integrity check in operation 165. From operation 166, the method can proceed to operation 162, which allows the user to correct the flaws in the design.

The integrity check can be performed in numerous ways. In one embodiment, operation 162 would only allow for discrete changes of dimensions. Thus, there would be a finite number of possible vehicle configurations that can be created. A table, matrix, or database, etc., can be maintained of all possible design choices and whether each set of design choices will pass the integrity check or not. This can be determined ahead of time by the developers of the software in numerous manners, for example, actually constructing each configuration of vehicle themselves, or using engineering software to test the virtual vehicle designs in a virtual wind-tunnel, etc. The table is then referred to during the integrity check to see if the current design choices will result in a stable vehicle.

If in operation 163, the user is done adjusting the elements, then the instead of proceeding to operation 165, the method can alternatively proceed to operation 164, which performs a simulation animation. The user can choose whether to activate the simulation animation (operation 164) or instead proceed directly from operation 163 to operation 165. The simulation animation visually simulates for the user the operation of the currently designed model vehicle. For example, if the user wants to try flying an airplane that is currently being designed, the program (or a different program) can animate the airplane flying. The animation would show the airplane flying with the same aerodynamic characteristics that the designed plane would have. Thus, for example, if the modeled aircraft contained a design flaw which would cause it to crash if it were printed and constructed as described herein, then the animation would show the plane flying in the same manner as the flawed plane would actually fly, eventually crashing. For example, if the plane were designed with wings that were too short, the animated plane would move on the ground but not take off, and a message to the user can indicate that the reason the plane cannot take off is that the wings are too short. If the plane were designed with a tail in an improper shape, then the animation might show the plane steering and flying erratically (just as the improperly designed plane would fly if constructed), and then possibly crash. A message could instruct the user that the tail was designed in an improper shape which caused the flight trouble. The program could also optionally offer to automatically correct the tail shape for the user on the three dimensional model. A similar simulation can be offered for model cars, boats, hovercrafts, etc. This simulation animation can alternatively be offered at any other point in the flowchart.

If the integrity check is passed in operation 165, then the method can proceed to operation 167, which allows the user to paint some or all of the elements. The user can paint them using selected colors, patterns, or external image files that the user may already have (e.g., a picture of the user's wife or husband).

From operation 167, the method can proceed to operation 168, which determines the indicia (what is actually printed out) to print on each of the sheets. This can be determined in numerous ways. For example, in the simplest embodiment, wherein a user does not change dimensions of elements, the indicia is prestored (e.g., as a color PDF or other image file) for each vehicle type and simply printed. When the user changes dimensions of elements, the software can store the indicia in an image vector format and the indicia can be resized in proportion to the dimension changes by the user. Alternatively, any freestyle three dimensional changes made by the user can be projected onto the two dimensional sheets using known mathematical algorithms. For example, GOOGLE distributes a 3-D design tool known as "Sketchup." Three-dimensional models can then be read by a software package known as "Pepakura designer" available from Tama Software which takes three dimensional models and renders them on two dimensional sheets so they can be cutout and assembled together. Another off the shelf tool that can be used to create 2-dimensional flat patterns from a 3-dimensional model is a GOOGLE SKETCHUP plug-in entitled "Unfold Tool."

From operation 168, the method can proceed to operation 169 which actually prints the indicia (or flat pattern) on the sheets. Preferably a color printer is used so that color indicia and markings can be used for the vehicle for a more pleasing appearance. The sheets can then be used to actually construct a physical toy, by cutting and/or folding the sheets along lines printed on the sheets, and attaching parts of the sheets together (e.g., glue, tape, etc.) Now the user has an actual physical body of a vehicle that the user designed using the modeling program in operations 160-163. With the physical body, the user can now attach the other components of the system described herein (e.g., controller, chassis, etc.) to finish the vehicle and operate it. The two dimensional sheets (or flat pattern sheets) that are printed can be considered to "embody" the three dimensional model created in operations 160-163. That is, even though the sheets are two-dimensional, the sheets can be used as described herein to construct a three dimensional toy embodied by the sheets.

It is noted that the operations illustrated in FIG. 21 can be implemented in any logical order, for example the integrity check (operation 165) can be performed after each modification of an element (operation 162). Also painting (operation 167) can be performed contemporaneously with the adjustment of elements (operation 162), or any other operation. FIG. 21 merely illustrates one example of operations and their sequence. However, it can be appreciated that the computer software can operate using many different operations and in different sequences.

It is further noted that if an adjustable chassis is being used, the method can communicate to the user at what length the chassis should be expanded to. This communication can come in the form of an output during design (e.g., operation 162 or any other operation) and/or printing on the sheets (in operation 169) the length the chassis should be expanded to. Alternatively, no such communication is provided to the user and the user can adjust the adjustable length chassis using his or her own best judgment.

Figure 22:
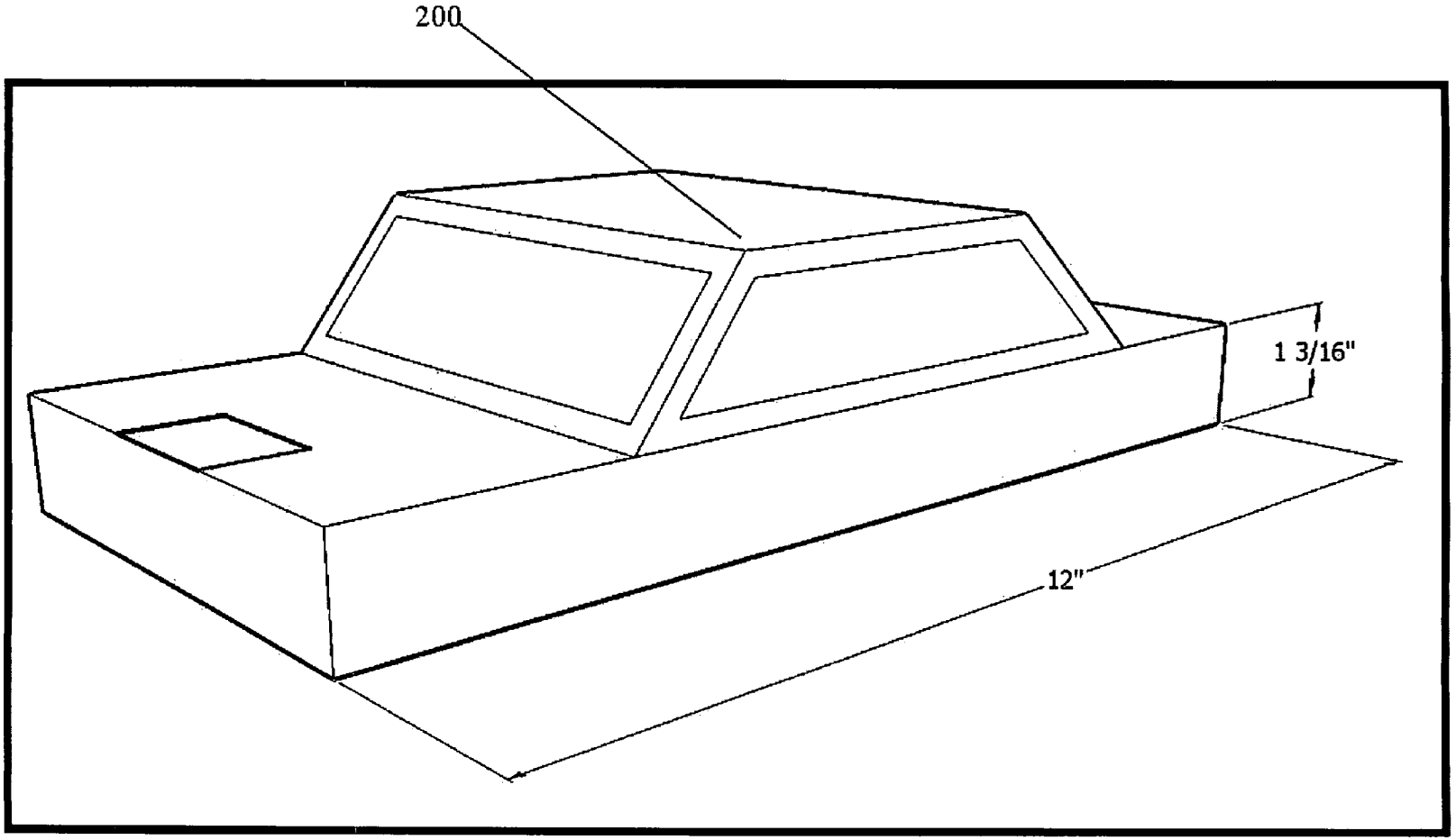
FIG. 22 is a screen shot illustrating a first virtual three-dimensional car model, according to an embodiment.

FIG. 22 is a screen shot illustrating a first virtual three-dimensional car model, according to an embodiment.

A first virtual three dimensional car 200 (although any type of vehicle can be modeled) using conventional three dimensional modeling techniques. For example known three dimensional modeling tools can be used, such as 3DSMAX, MAYA, etc. Original wireframe vehicles can be provided to the user upon which the user can make changes to them as described herein (for example see FIG. 21 and the accompany description). The user can change appearances and dimensions of parts.

Figure 23:
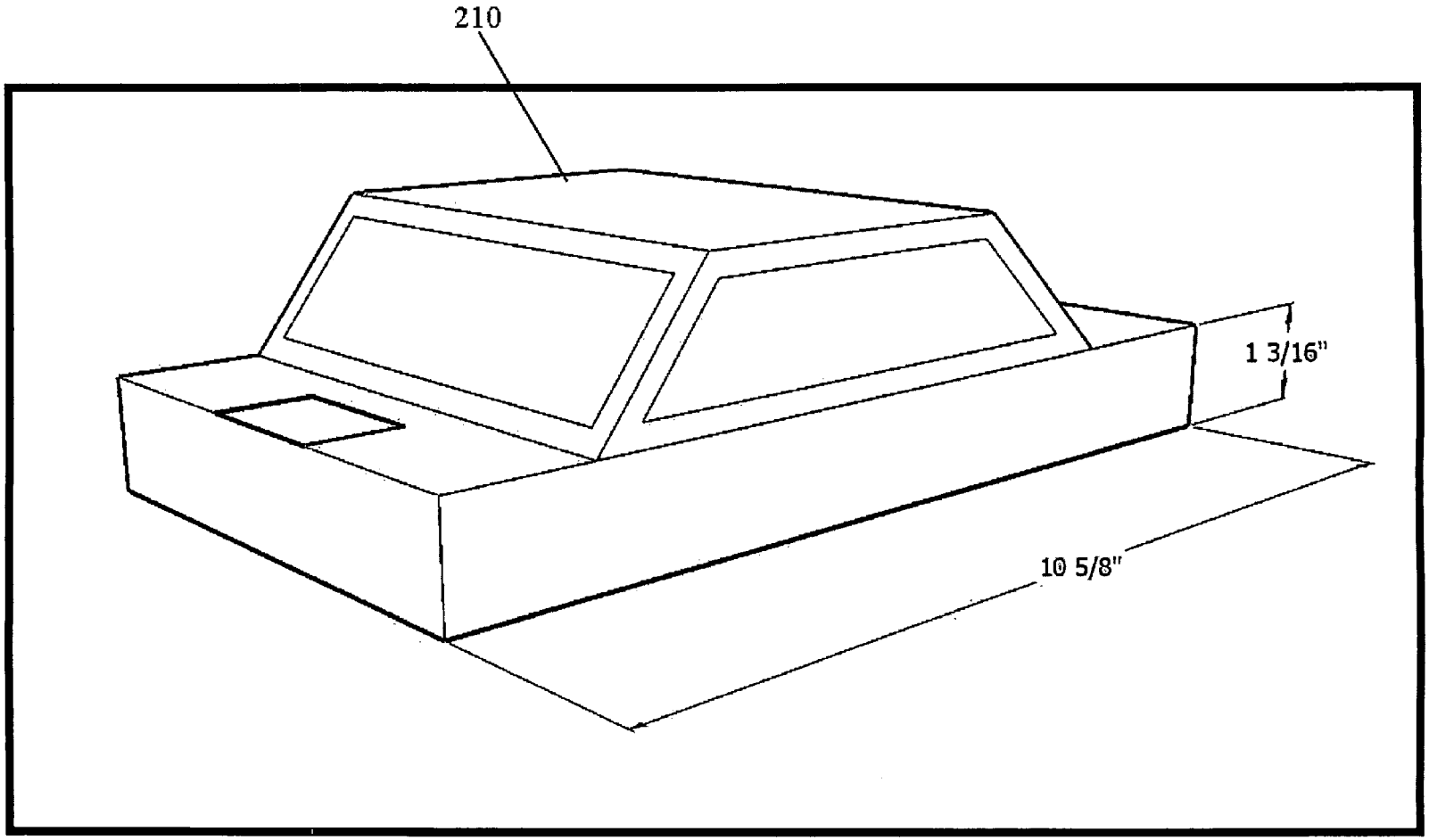
FIG. 23 is a screen shot illustrating a second virtual three-dimensional car model, according to an embodiment.

FIG. 23 is a screen shot illustrating a second virtual three-dimensional car model, according to an embodiment.

The second virtual three dimensional car 210 is created by shrinking the length of the first virtual three dimensional car 200. This can be done using the modeling program.

Figure 24:
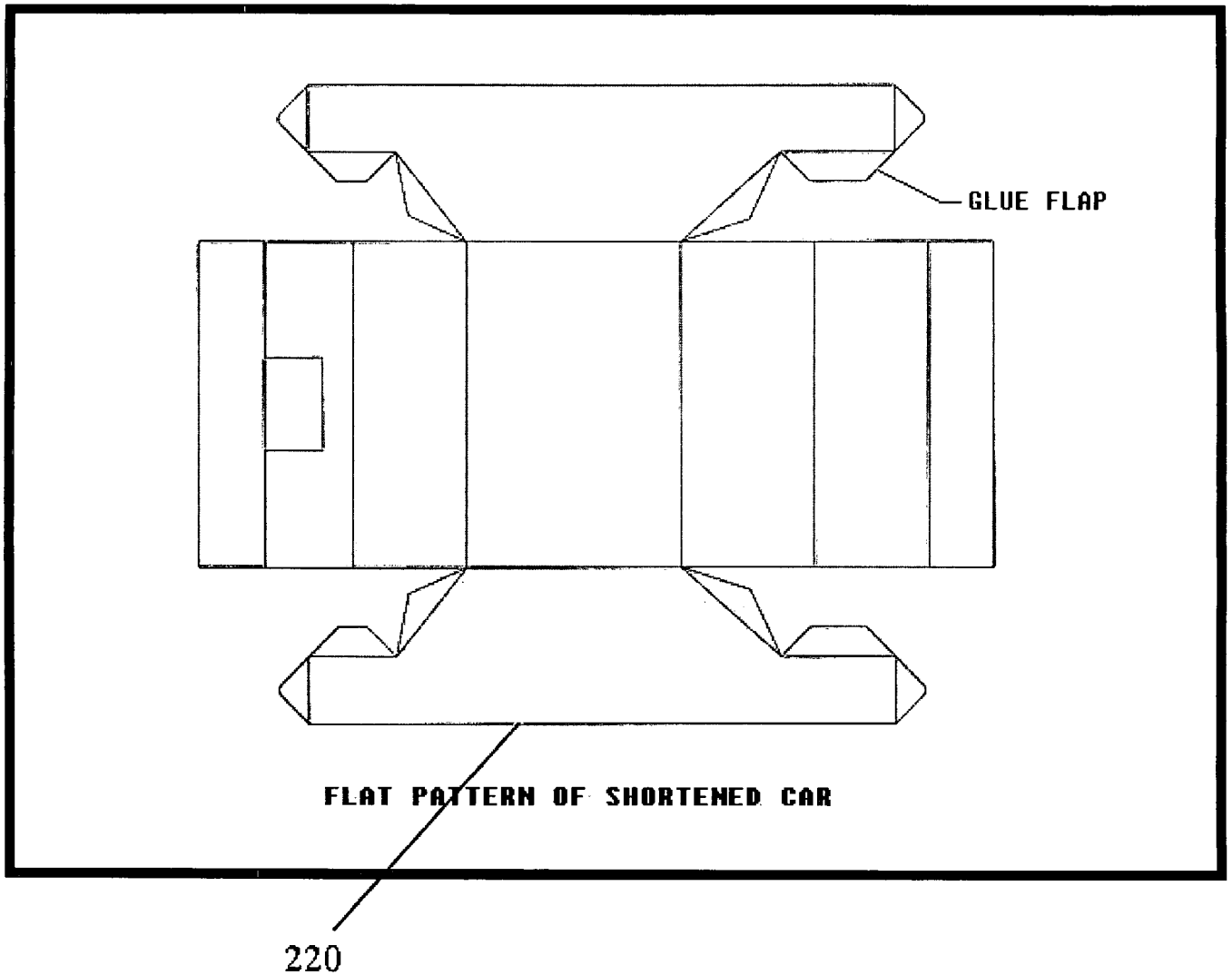
FIG. 24 is a sheet of paper containing a flat pattern of the second virtual three-dimensional car model, according to an embodiment.

FIG. 24 is a sheet of paper containing a cut out model of the second virtual three-dimensional car, according to an embodiment.

When the user is finished designing his or her car, the user can instruct the software to convert the three dimensional model he or she is working on to two dimensional paper and print it out. Flat pattern printout 220 is a printout on paper (or any other printable substrate) of the second virtual three dimensional car 210. The flat pattern printout 220 can be cutout along lines on the flat pattern printout 220, and then folded/glued together to create real life three dimensional representation of the three dimensional virtual model the user instructed the software to convert to two dimensions and print out (in this case the second virtual three dimensional car 210). The flat pattern printout 220 can comprise one or more pages, depending on the complexity of the embodied model.

Figure 25:
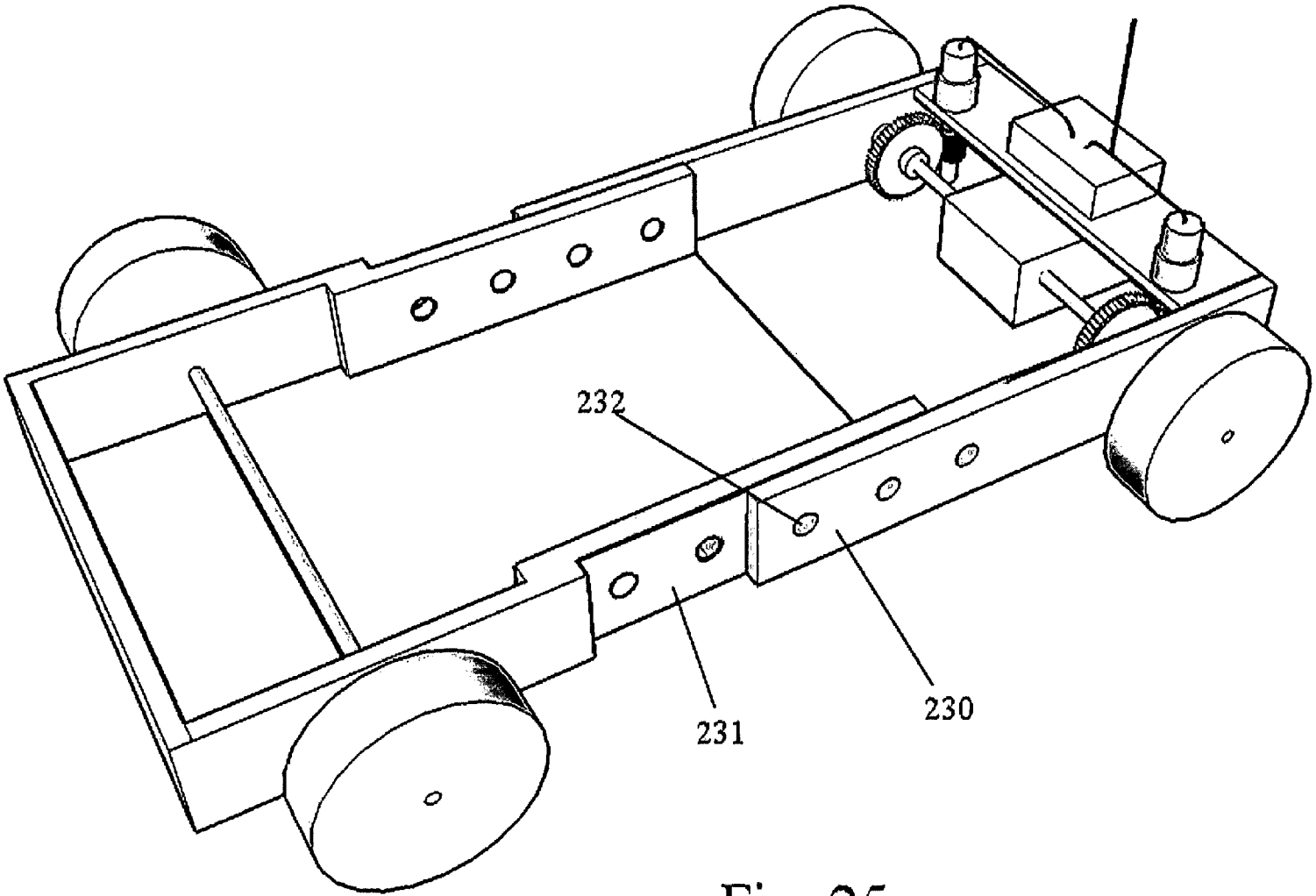
FIG. 25 is a drawing illustrating a telescoping chassis in an elongated configuration, according to an embodiment.

FIG. 25 is a drawing illustrating a telescoping chassis in an enlarged configuration, according to an embodiment.

A telescoping (or collapsible) chassis comprises a front portion 231 and a rear portion 230 The front portion 231 slides along the rear portion 230 so that an overall length of the chassis can be variable to match a size of the vehicle that has been printed out and assembled. Holes exist on both sides of the rear portion 230 and both sides of the front portion 231. A pin, plug, or other small stopper can be inserted through two lined up holes (one in the rear portion 230 and one in the front portion 231. For example, a stopper (not pictured) can be inserted through hole 232 in order to secure the front portion 231 and the rear portion 230 at this particular length. Of course, once a stopper(s) is inserted, the front portion 231 and the rear portion 230 will be prevented from sliding. To slide the portions, any stopper(s) should first be removed.

Figure 26:
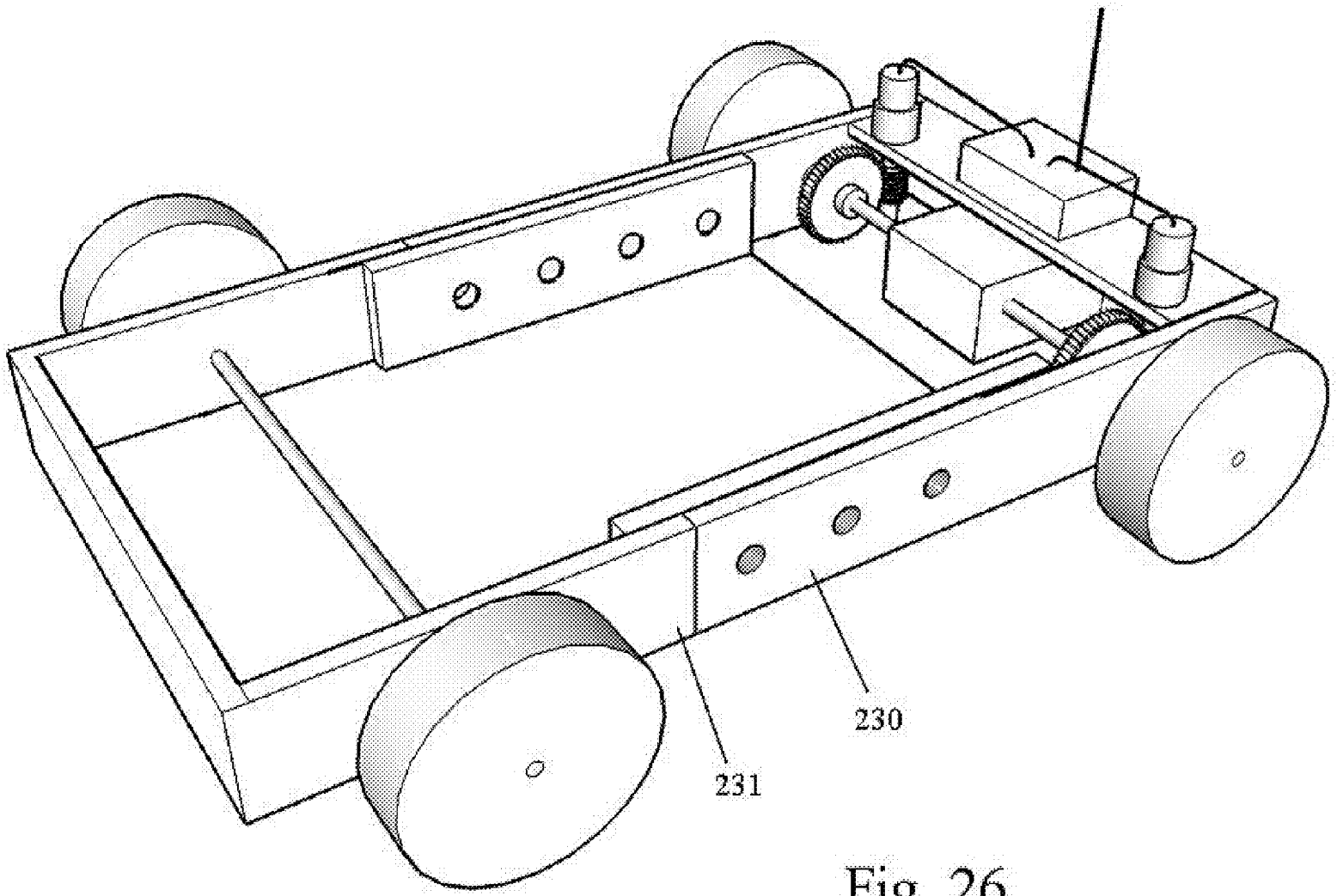
FIG. 26 is a drawing illustrating the telescoping chassis in FIG. 25 in a shortened configuration, according to an embodiment.

FIG. 26 is a drawing illustrating the telescoping chassis in FIG. 25 in a shortened configuration, according to an embodiment.

The telescoping chassis illustrated in FIG. 26 is the chassis illustrated in FIG. 25 but with the rear portion 230 fully inserted into the front portion 231 thereby putting the telescoping chassis in its shortest position possible. Before attaching a paper model on top of the collapsible chassis, a stopper should be inserted through at least one pair of holes on the left side and one pair of holes on the right side. When a model is designed, in an embodiment the software can inform the user as to what length the telescoping chassis should be set at (length can be measured in numerous ways, e.g., number of inches, number of visible holes, etc.)

FIG. 27 is a drawing illustrating a steering linkage of a chassis, according to an embodiment. This steering linkage can be used with a telescoping chassis or on a fixed length chassis. The steering linkage is used to steer the vehicle using a remotely controlled motor.

A power supply 240 provides power to a propelling motor 242 for turning a first axle 239 which turns wheels which would propel the chassis 241. Attached to the chassis 241 can be a cutout vehicle body (not pictured). The power supply 240 can also provide power to a receiver (not pictured) which receives signals from a remote control and processing unit (not pictured) which controls the propelling motor 242 and a steering motor 243.

The power supply 240 can also provide power to the steering motor 243 housed in a steering motor housing 244, the steering motor housing 244 attached to a motor platform 247. The motor platform 247 is fixedly attached to a front of the chassis. The steering motor 243 turns a worm gear 245 which turns in cooperation with a rack gear 246. The rack gear 246 is positioned under the worm gear 245 so that when the worm gear 245 is turned by the steering motor 243, the rack gear 246 moves in response to the turning worm gear 245.

The rack gear 246 is connected to a tie rod 249 so that when the rack gear 246 moves, the tie rod 249 moves along with the rack gear 246, thereby turning a steering arm 248 along with it. A first end of the steering arm 248 is pivotally attached to the tie rod 249 and a second end of the steering arm 248 is pivotally attached to the motor platform 247 which allows the tie rod 248 to move left and right while the motor platform 247 remains stationary. A second steering arm on an opposite side of the steering arm 248 operates similarly and is also turned by the tie rod 249.

A second axle 250 is rotatably attached to the steering arm 248 so that when the steering arm 248 turns, the second axle 250 turns which turns wheels attached to the second axle 250 about a pivot axis which steer the vehicle. The steering motor 243 can be controlled remotely to turn in both directions (forward, reverse) which would turn the wheels in either direction (left, right).

This is just one example of a mechanism that can be used to remotely steer a toy vehicle, of course other configurations can be used as well.

Figure 28:
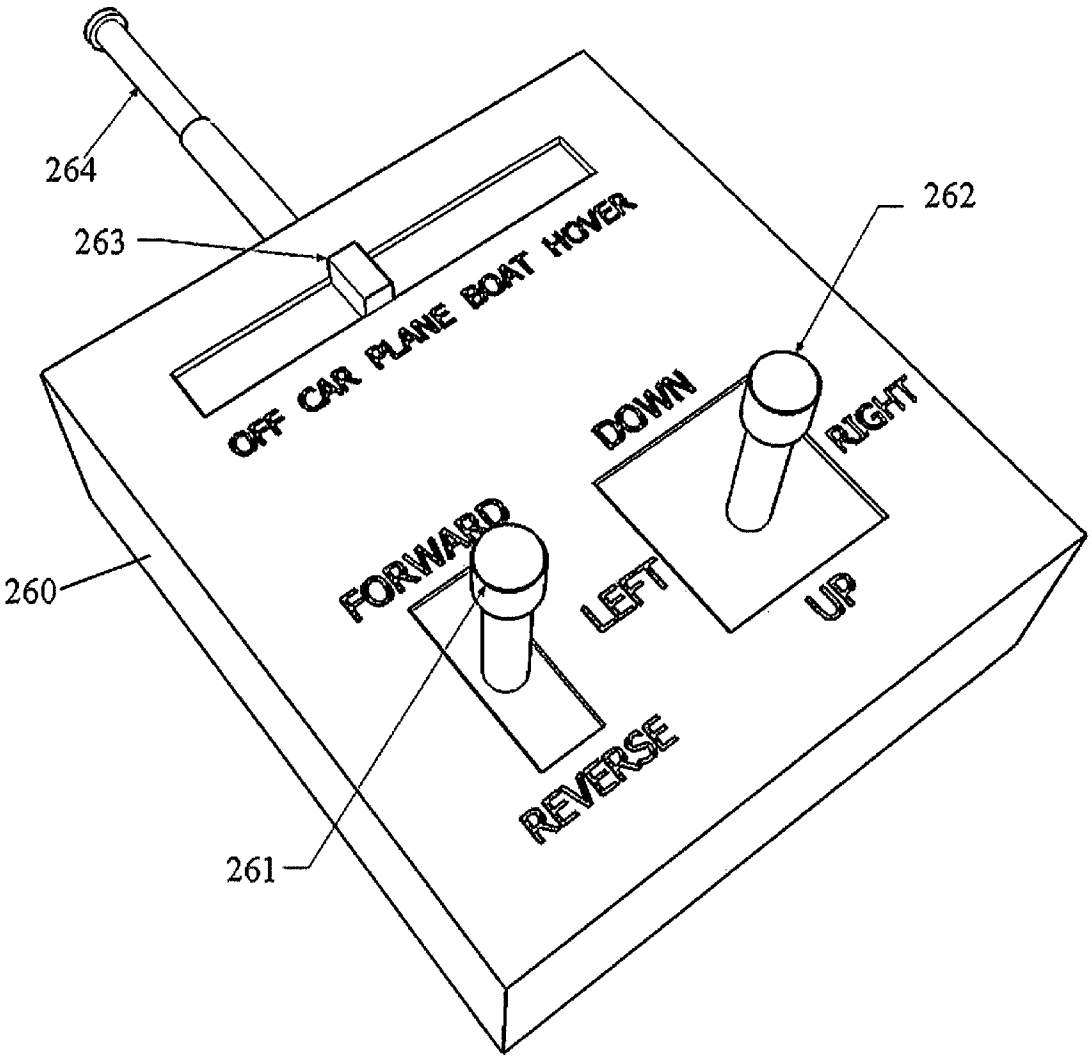
FIG. 28 illustrates one example of a remote control, according to an embodiment.

FIG. 28 illustrates one example of a remote control, according to an embodiment.

All of the input mechanisms on the remote control unit 260 (e.g., buttons switches, levers, etc.) can be considered control input. A user operates the control input by pressing or operating the control input (e.g., buttons, etc.) to remotely control a toy vehicle configured to receive signals from the remote control. When the user operates the control input, there is a reaction on the toy vehicle depending on the control input that has been operated. For example, if user can control a motor on a toy car go forward or reverse by pressing the forward/reverse joystick 261 in the appropriate direction. The signal received at the toy car is processed and output to motors (or other electronic devices on the toy car) which can be considered control output. For example, if the user presses the forward/reverse joystick 261 forward (an operation of the control input), the ultimate reaction is power being sent to a propelling motor on the toy in a forward direction (the control output), thereby propelling the car forward.

A remote control unit 260 is comprises a transmitter used to control a remote controlled vehicle. The forward/reverse joystick 261 is used to control a motor(s) that propels a vehicle to operate in either forward or reverse (for example, see propelling motor 242). Steering joystick 262 is used to steer the vehicle by controlling motor(s) used to steer the vehicle (for example, see steering motor 243). Steering joystick 262 can also be used to control more than one motor to steer a vehicle, for example in a plane implementing differential thrust as a mechanism for steering, the steering joystick 262 can control both a left motor and a right motor on the plane at different power levels in order to steer the plane according to a direction the joystick is pushed in. The steering joystick 262 can optionally also control rudder, ailerons, and elevator movement on an air vehicle to climb/dive by pushing the joystick up/down.

A vehicle selection switch 263 can be used to select a type of vehicle being controlled. Each type of vehicle may have its own unique characteristics. For example, a land vehicle such as a car will steer left and right using a steering linkage (see FIG. 27) and a propelling motor will go forward and reverse. Thus, when the vehicle selection switch 263 is set to car, the steering joystick 262 operates a steering motor and the forward/reverse joystick 261 operates a propelling motor. Thus, when "plane" is selected on the switch, and if there are two propelling motors (one for each side), each motor would not be allowed to operate in reverse directions. Alternatively, if "car" is selected on the switch, and there are two propelling motors (one for each side), each motor could be allowed to operate in reverse directions, thereby spinning the car around.

A certain amount of power is needed to keep an airplane in the air. Thus, when the plane option is selected on the vehicle selection switch 263, the controller keeps the motors on the plane operating at a minimum power level to keep the plane aloft, regardless of the setting of the forward/reverse joystick. In addition, to turn the plane left using differential force, less power is given to the left motor on the plane than to the right motor, thereby turning the plane left. To turn the plane right using differential force, less power is given to the right motor on the plane than to the left motor, thereby turning the plane right. Thus, for the plane setting on the vehicle selection switch 263, the steering joystick adjusts power to two motors on the plane. This is in contrast to the car setting on the vehicle selection switch 263, wherein operating the steering joystick 262 adjusts power to a steering motor on the toy car. Alternatively, instead of using differential force to steer the plane, a rudder can be used which can be controlled by an additional motor which would be controlled by the steering joystick 262. For a plane that steers using a rudder, the remote transmitter would require a different setting than for a plane that steers using differential force.

A boat, unlike a car or plane, should be able to reverse one motor while having the other motor go forward, so that the boat will spin about its centerline. So selecting the boat option on the vehicle selection switch 263 will allow the controller to allow one motor to operate in one direction while allowing the other motor to operate in the reverse direction.

The optimum electronics configuration will vary depending on the vehicle and its design, and it may be that for some hovercraft the boat setting works best and for some boats the hovercraft setting works best. Thus, for example, the vehicle selection switch 263 adjusts a relationship between commands inputted into the remote control unit and outputs to motors on the remote toy vehicle. For example, having the forward/reverse joystick 261 in a center position would send no power to a propelling motor(s) on a car if the vehicle selection switch 263 is set to car (so the car remains stationary), but would sent a predetermined amount of power (current) to a propelling motor(s) on an airplane if the vehicle selection switch 263 is set to plane in order to keep the plane's motors running to keep the plane aloft.

The vehicle selection switch 263 affects operation of a toy vehicle being controlled remotely in one of two ways. The remote control transmitter 260 itself uses the setting of the vehicle selection switch 263 to convert positions of the joysticks (and any other controls located on the remote control unit 260) to determine motor power, which is then transmitted to the remote controlled toy vehicle and a controller on the vehicle receives respective motor power(s) for each motor (and other operative device) and outputs the respective amount of power to each motor. Thus, in this embodiment, the remote control unit 260 itself determines how the vehicle's motors are to be controlled based on the setting of the vehicle selection switch 263. For example, if the vehicle selection switch 263 is set to airplane, then the remote control unit 260 will transmit a minimum power level instruction to the toy vehicle for each motor on the airplane even if the forward/reverse joystick 261 is not being operated (in center position), in order to keep the airplane aloft. If the vehicle selection switch 263 is set to car, then if the forward/reverse joystick 261 is not being operated (in center position), the toy car will not move since the propelling motor(s) therein will not be given any power by the car's controller. Thus, the remote control unit 260 receives operations of the control input on the remote control unit 260, determines based on the setting of the vehicle selection switch 263 the power level to each of the individual motor(s) on the toy vehicle, then transmits those power level instructions to the receiver on the toy vehicle itself which receives the individual power levels instructions for each motor(s) and uses a processing unit to output the received amount of power to each of the motors on the toy vehicle. The determination of power levels to each of the individual motor(s) can also be made by a processing unit on the toy vehicle itself.

In a further embodiment, a controller located on the toy vehicle itself receives the setting of the vehicle selection switch 263 remotely and controls the motors on the toy vehicle (and any other operative device) according to the setting of the vehicle selection switch 263.

Thus, in one kit, an operator can design and design and construct a variety of different types of toy vehicles (e.g., car, airplane) from flat patent printouts, and can use the same components, such as motor(s) and a controller (which can comprise a power supply, receiver, processing unit) for each different type of vehicle. Using the same components can reduce the cost of the kit.

Furthermore, whenever the terms "toy," "vehicle," "car," "plane," "airplane," or the like are used herein, it can refer to such items made using the methods described herein, that is constructed from a flat pattern sheet into a three dimensional object. Further, all of the methods described herein that can be performed by a digital computer can be stored on a computer readable storage medium and may optionally be accessed via a remote server.

It will thus be seen that combining a number of paper fabrication and design selection criteria with interchangeable pre-assembled power drive and remote control enabling modules that a new and novel integrated paper model assembly and activation kit of the invention has been illustrated and described and it will be apparent to those skilled in the art that various changes and modifications may be made thereto without departing from the spirit of the invention.

The invention claimed is:

1. A method to create toy vehicles, the method comprising:

choosing, using computer modeling software, a pattern from a plurality of predesigned patterns comprising an air vehicle and a land vehicle, wherein the land vehicle has no wings or other structure configured to lift the land vehicle off ground, and the air vehicle has wings configured to lift the air vehicle off ground;

creating, using computer modeling software, a customized pattern by editing the pattern;

printing, using computer modeling software, a printed form of the customized pattern which is a two-dimensional printout which embodies an assembled vehicle;

assembling the assembled vehicle from the printed form; and controlling the assembled vehicle using a transmitter configured to control the assembled vehicle when the assembled vehicle is the air vehicle to enable flying of the air vehicle and the transmitter also configured to control the assembled vehicle when the assembled vehicle is the land vehicle to enable travel on land of the land vehicle and not flight of the land vehicle.

2. The method as recited in claim 1, wherein before the controlling, providing the transmitter with a switch selectable between a first position for the land vehicle and a second position for the air vehicle which is configured to send different signals based on the position of the switch.

3. The method as recited in claim 2, wherein after the providing and before the controlling, when the assembled vehicle is the land vehicle switching the switch to the first position and when the assembled vehicle is the air vehicle switching the switch to the second position.

4. The method as recited in claim 1, wherein the transmitter is provided in a kit.

* * * * *